US008151835B2

(12) United States Patent
Khan et al.

(10) Patent No.: US 8,151,835 B2
(45) Date of Patent: Apr. 10, 2012

(54) AUTOMATED DRUG DELIVERY BAG FILLING SYSTEM

(75) Inventors: Abdul Wahid Khan, Lindenhurst, IL (US); Dennis Tribble, Ormond Beach, FL (US); Joel A. Osborne, Port Orange, FL (US)

(73) Assignee: FHT, Inc., Englewood, CO (US)

( * ) Notice: Subject to any disclaimer, the term of this patent is extended or adjusted under 35 U.S.C. 154(b) by 1195 days.

(21) Appl. No.: 11/766,453

(22) Filed: Jun. 21, 2007

(65) Prior Publication Data

US 2008/0051937 A1 Feb. 28, 2008

Related U.S. Application Data

(60) Provisional application No. 60/823,345, filed on Aug. 23, 2006.

(51) Int. Cl.
*B65B 3/04* (2006.01)

(52) U.S. Cl. ..... 141/114; 141/10; 141/166; 141/315

(58) Field of Classification Search ..... 141/10, 141/114, 165–166, 313–315
See application file for complete search history.

(56) References Cited

U.S. PATENT DOCUMENTS 2,880,723 A 4/1959 Adams
2,981,432 A 4/1961 Flood
2,988,984 A 6/1961 Eckert
3,200,486 A 8/1965 Shields
3,527,017 A 9/1970 Taylor et al.
3,736,933 A 6/1973 Szabo
3,823,818 A 7/1974 Shaw
3,835,897 A 9/1974 Gess
3,848,485 A 11/1974 Grenci
3,865,236 A 2/1975 Rycroft
3,880,211 A 4/1975 Gess
3,965,945 A 6/1976 Ross
4,058,121 A 11/1977 Choksi et al.
4,472,357 A 9/1984 Levy et al.
4,502,616 A 3/1985 Meierhoefer
(Continued)

OTHER PUBLICATIONS

U.S. Appl. No. 11/466,354, Osborne et al.

(Continued)

*Primary Examiner* — Gregory Huson
*Assistant Examiner* — Nicolas A Arnett
(74) *Attorney, Agent, or Firm* — Leason Ellis LLP

(57) ABSTRACT

An automated medication preparation system for delivering a dosage of medication to a drug delivery bag having a fill port through which the medication is delivered into the bag includes an automated transport device for controllably delivering each drug delivery bag from one location to another location via a driven member. The system has a carrier that releasably captures and holds a portion of the bag and orients each bag such that the fill port of each bag is positioned at a uniform location relative to the carrier. The carrier is coupled to the transport device such that movement of the driven member is translated into movement of the carrier and the captured drug delivery bag. An automated drug delivery device is part of the system and includes a drug delivery member that sealingly mates with the fill port for delivering the dosage of medication to the bag. A controller is in communication with the automated transport device for moving the automated transport device in an indexed manner, including moving the carrier to a fill location where the fill port and the drug delivery member are aligned to permit the sealed mating between the two and transfer of the dosage of medication.

23 Claims, 10 Drawing Sheets

U.S. PATENT DOCUMENTS 4,512,475 A 4/1985 Federighi et al.
4,624,148 A 11/1986 Averette
4,639,250 A 1/1987 Rycroft
4,674,652 A 6/1987 Aten et al.
4,699,186 A 10/1987 Palin et al.
4,758,230 A 7/1988 Rycroft
4,773,285 A 9/1988 Dionne et al.
4,842,028 A * 6/1989 Kaufman et al. ..... 141/114
4,861,335 A 8/1989 Reynolds et al.
4,865,592 A 9/1989 Rycroft
4,944,736 A 7/1990 Holtz
5,004,962 A 4/1991 Fonss et al.
5,040,437 A 8/1991 Mueller
5,229,074 A 7/1993 Heath et al.
5,256,154 A 10/1993 Liebert et al.
5,288,285 A 2/1994 Carter
5,341,854 A 8/1994 Zezulka et al.
5,356,393 A 10/1994 Haber et al.
5,363,885 A 11/1994 McConnell et al.
5,431,201 A 7/1995 Torchia et al.
5,451,528 A 9/1995 Raymoure et al.
5,477,896 A * 12/1995 Grifols Lucas ..... 141/114
5,479,969 A 1/1996 Hardie et al.
5,496,288 A 3/1996 Sweeney
5,542,935 A 8/1996 Unger et al.
5,597,530 A 1/1997 Smith et al.
5,651,775 A 7/1997 Walker et al.
5,669,599 A 9/1997 Toh et al.
5,704,921 A 1/1998 Carilli
5,735,181 A 4/1998 Anderson
5,769,086 A 6/1998 Ritchart et al.
5,805,454 A 9/1998 Valerino, Sr. et al.
5,826,409 A 10/1998 Slepicka et al.
5,855,839 A 1/1999 Brunel et al.
5,884,457 A 3/1999 Ortiz et al.
5,899,889 A 5/1999 Futagawa et al.
5,911,252 A 6/1999 Cassel
5,948,360 A 9/1999 Rao et al.
6,027,472 A 2/2000 Kriesel et al.
6,048,086 A 4/2000 Valerino
6,068,614 A 5/2000 Kimber et al.
6,142,039 A 11/2000 Herring, Sr.
6,200,289 B1 3/2001 Hochman et al.
6,343,690 B1 2/2002 Britton et al.
6,360,794 B1 3/2002 Turner
6,599,476 B1 7/2003 Watson et al.
6,623,455 B2 9/2003 Small et al.
6,813,868 B2 11/2004 Baldwin et al.
6,915,823 B2 7/2005 Osborne et al.
7,610,115 B2 * 10/2009 Rob et al. ..... 700/245
7,783,383 B2 * 8/2010 Eliuk et al. ..... 141/114
7,930,066 B2 * 4/2011 Eliuk et al. ..... 221/2
2001/0018937 A1 9/2001 Nemoto
2002/0198738 A1 12/2002 Osborne
2004/0250842 A1 12/2004 Adams et al.
2005/0252572 A1 11/2005 Khan et al.
2005/0252574 A1 11/2005 Khan et al.
2006/0178578 A1 8/2006 Tribble et al.
2006/0201575 A1 9/2006 Osborne

OTHER PUBLICATIONS

U.S. Appl. No. 11/551,608, Osborne et al.
U.S. Appl. No. 11/551,574, Tribble et al.
U.S. Appl. No. 11/551,555, Bender et al.
U.S. Appl. No. 11/554,677, Tribble et al.
U.S. Appl. No. 11/765,093, Khan et al.

* cited by examiner

Fig. 3
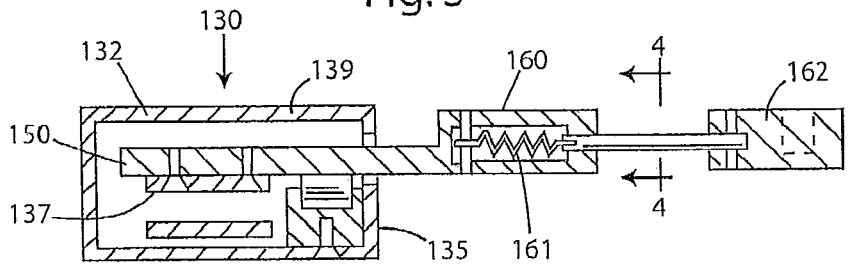
Fig. 4
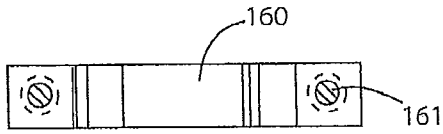
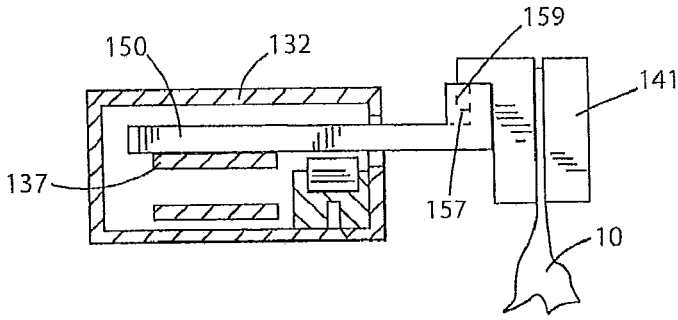
Fig. 6
Fig. 5
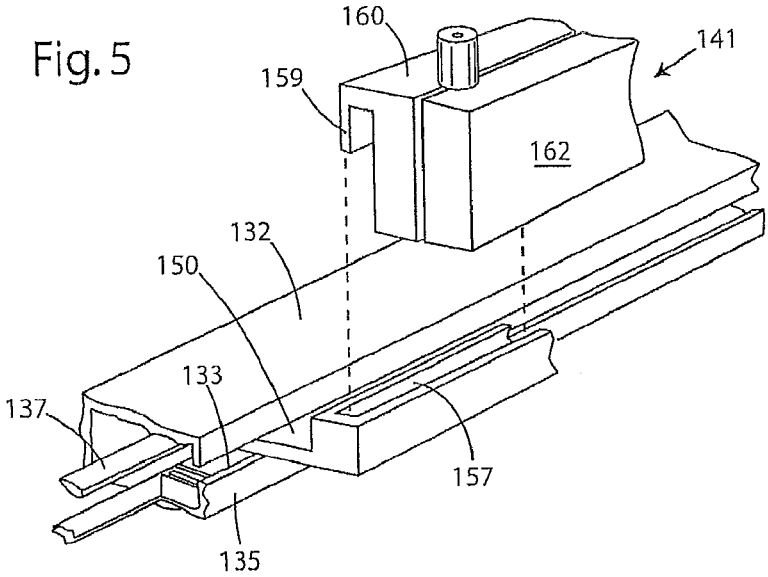

AUTOMATED DRUG DELIVERY BAG FILLING SYSTEM

CROSS REFERENCE TO PRIOR APPLICATION

This application claims priority to U.S. Provisional Application No. 60/823,345 filed on Aug. 23, 2006, which is incorporated by reference herein in its entirety.

TECHNICAL FIELD

The present invention relates generally to medical and pharmaceutical equipment, and more particularly, to an automated system for receiving and handling drug delivery bags (IV bags) and preparing and delivering a drug preparation (dosage) into the drug delivery bag.

BACKGROUND

There are a number of different types of drug delivery devices that are all configured to receive, hold and dispense a dosage of medication. For example, one type of drug delivery device that is commonly used in a medical or pharmaceutical setting is a disposable syringe. Another drug delivery device that is commonly used to administer medication to a patient is an infusion or drug delivery bag. In particular, the drug delivery bag can be an IV (infusion) bag that is a flexible container whose inner cavity is sterile and which is optionally totally or partially filled with a sterile, pyrogen-free fluid intended for infusion into the arteriovenous system of humans or animals. Such bags can be purchased already filled and labeled from a manufacture, or can be purchased empty to be filled with appropriate fluids in a pharmacy. Infusion bags are utilized for intravenous delivery of fluids and medication to human beings or animals. For this reason, the infusion bag is provided with at least one outlet channel (infusion port) through which fluid can flow through an infusion line to a connecting device such as, for example, a cannula/catheter that is inserted through the skin into a vein, such as a peripheral vein and an inlet channel (fill port) through which medication can be injected.

There are a number of different intravenous access methods for delivering the medication to the patient. Fluids contained in the IV bags can be administered continuously or intermittently. When administered intermittently, the fluid can be co-administered through an IV set through which continuous administration of another fluid is already occurring or can be administered through its own arterio-venous access. The process of co-administering an intermittently administered IV fluid with a continuously running IV fluid is called "piggybacking".

Accordingly, one conventional IV arrangement is for the IV bag to contain an infusion fluid and then either another IV bag or some other structure contains the medication to be delivered. The medication is then delivered in a controlled manner with the infusion fluid to the vein of the patient. This is a labor intensive manual process and requires careful precision in selecting the correct drug and the correct amount that is delivered to the patient. In addition, human touch contamination is the single most common form of dose contamination, and therefore, there is a desire to automate the process so as to minimize or eliminate the opportunity for such contamination by removing the human from the production process.

In a number of different applications automating the medication preparation process would result in increased production and efficiency being achieved. Such automation finds particular utility in settings, such as hospitals, where pharmacies prepare a large number of these doses daily. This would result in reduced production costs and also permits the system to operate over any time period of a given day with only limited operator intervention for manual inspection to ensure proper operation is being achieved. Such automation would find particular utility in settings, such as large hospitals, including a large number of doses of medications that must be prepared daily. Traditionally, these doses have been prepared manually in what is an exacting but tedious responsibility for a highly skilled staff. In order to be valuable, automated systems must maintain the exacting standards set by medical regulatory organizations, while at the same time simplifying the overall process and reducing the time necessary for preparing the medications, and, where practical, eliminating human manipulation and the attendant possibility of touch contamination.

Previous methods of dispersing the medication from a vial and into a drug delivery device, such as a syringe or IV bag, were very time consuming and labor intensive. More specifically, medications and the like are typically stored in a vial that is sealed with a safety cap or the like. In conventional medication preparation, a trained person retrieves the correct vial from a storage cabinet or the like, confirms the contents and then removes the safety cap manually. This is typically done by simply popping the safety cap off with one's hands. Once the safety cap is removed, the trained person inspects the integrity of the membrane and cleans the membrane. An instrument, e.g., a needle, is then used to pierce the membrane and withdraw the medication contained in the vial. The withdrawn medication is then placed into a drug delivery device to permit subsequent administration of the medication from the device. Many drugs cannot maintain adequate shelf life when stored in liquid form and so are provided in powdered form. In this case, the process is even more labor-intensive in that the preparation also involves the injection of a fluid (called the diluent) into the vial to liquefy the drug powder and agitation until the drug is completely liquified prior to aspiration of the resultant fluid from the vial and injecting that fluid into the IV bag. This can be a time consuming and labor intensive operation since first it must be determined how much diluent to add to achieve the desired concentration of medication and then this precise amount needs to be added and then the vial contents need to be mixed for a predetermined time period to ensure that all of the solid goes into solution. Thus, there is room for human error in that the incorrect amount of diluent may be added, thereby producing medication that has a concentration that is higher or lower than it should be. This can potentially place the patient at risk and furthermore, the reconstitution process can be very labor intensive since it can entail preparing a considerable number of drug delivery devices that all can have different medication formulations. This can also lead to confusion and possibly human error.

SUMMARY

An automated medication preparation system for delivering a dosage of medication to a drug delivery bag having a fill port through which the medication is delivered into the bag includes an automated transport device for controllably delivering each drug delivery bag from one location to another location via a driven member. The system has a carrier that releasably captures and holds a portion of the bag and orients each bag such that the fill port of each bag is positioned at a uniform location relative to the carrier. The carrier is coupled to the transport device such that movement of the driven member is translated into movement of the carrier and the captured drug delivery bag. An automated drug delivery device is part of the system and includes a drug delivery member that sealingly mates with the fill port for delivering the dosage of medication to the bag. A controller is in communication with the automated transport device for moving the automated transport device in an indexed manner, including moving the carrier to a fill location where the fill port and the drug delivery member are aligned to permit the sealed mating between the two and transfer of the dosage of medication.

The drug delivery bags can either be held in a horizontal manner or in a vertical manner as they are advanced from station to station and as a result, the dosage of medication is either delivered in a horizontal direction when the bag lies horizontally or in a vertical direction when the bag lies vertically as it is advanced from one station to another station.

Further aspects and features of the exemplary automated drug delivery bag filling system disclosed herein can be appreciated from the appended Figures and accompanying written description.

BRIEF DESCRIPTION OF THE DRAWING FIGURES

FIG. 3 is a cross-sectional view of the system of FIGS. 1A-1D illustrating a stabilizer component holding a drug delivery bag and a transport device for moving the bags;

FIG. 4 is a cross-sectional view of the stabilizer;

FIG. 5 is a perspective view of a stabilizer according to another embodiment for holding a drug delivery bag;

FIG. 6 is a cross-sectional view of the stabilizer of FIG. 5;

DETAILED DESCRIPTION OF PREFERRED EMBODIMENTS

FIGS. 1A-1D illustrate one exemplary automated system 100 for receiving, handling and filling drug delivery devices 10 which are in the form of intravenous containers (infusion devices), particularly drug delivery bags. The automated system 100 is divided into a number of stations where a specific task is performed based on the automated system 100 receiving user input instructions, processing these instructions and then preparing unit doses of one or more medications in accordance with the instructions. For purpose of illustration only, the present invention will be described in terms of the handling and processing of drug delivery bags (IV bags) 10; however, it will be appreciated that other drug delivery devices, such as a drug package, a container, etc., can equally be used and integrated into the present system 100.

Figure 2:
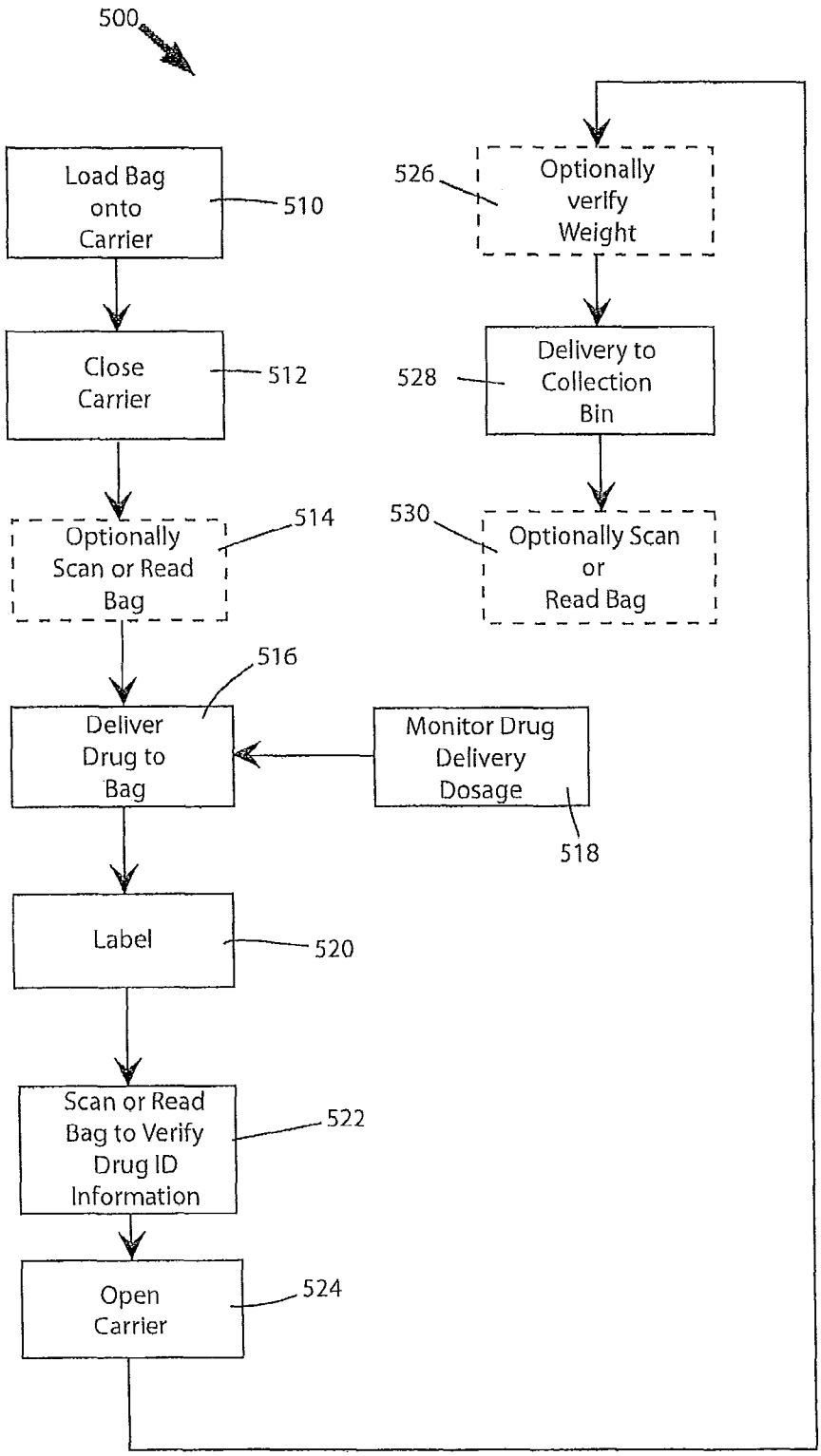
FIG. 2 is a flow chart illustrating the working components and operation of the system of FIGS. 1A-1D.

FIG. 2 is a flowchart 500 that shows exemplary various steps and operations that are performed at different stations that are associated with the system 100. A general method of filling the IV bag 10, in an automated manner, includes a step 510 of loading the IV bag 10 onto a carrier or the like that delivers the bag 10 from one station to another station in a controlled, indexed manner. At step 512, the carrier is closed to thereby capture the bag 10 so that it is securely held and ready for transport. At optional step 514, the bag 10 can be read (e.g., scanned or the like) to associate the bar code or RFID tag on the capturing device with the medication order that is being prepared since the empty syringes can come in bulk form with a syringe specific identifier, such as a barcode, that identifies each syringe. In other words, this initial scan can be used to either (a) verify the identity of the bag or (b) associate some identifier with the dose (medication) order that is being prepared. It will also be appreciated that the label or RFID tag can contain processing information or instructions that can be used in filling the bag 10 in an automated manner as is the case when the label is applied prior to read station.

At step 516, a prescribed dosage of medication is delivered to the bag 10 and at step 518, the dosage being delivered is monitored to check the accuracy of the drug filling step 516, as well as providing additional safety precautions. For example, the accuracy of the drug filling step can be a vision based system, such as the one described in commonly assigned U.S. patent application Ser. No. 11/055,545, which is hereby incorporated by reference in its entirety, or it can be based on a measurement of the refractive index, or the dose can be measured using a noninvasive flow sensor at the point of delivery. At step 520, the filled bag 10 is labeled and at step 522, the bag 10 and/or label is read to verify drug identification information, as well as other information, including patient identification information and drug delivery instructions. At step 524, the carrier is opened to permit removal of the bag 10. Step 526 is an optional weight verification step where the accuracy of the filled bag is checked (in one embodiment, the weight is measured both prior to delivery of the medication and after delivery of the medication). If all identification and safety precautions are confirmed, the bag 10 is delivered to a collection bin or the like. At step 530, the bag 10 can be read again at the collection site to verify its locations and placement as well as any other routing information, etc.

Referring again to FIGS. 1A-1D, the automated system 100 includes a first station 110 where empty drug delivery bags 10 are stored. It will be appreciated that the first station 110 can store a number of drug delivery bags 10 of different sizes (e.g., infusion bags having different maximum volumes). As a result, one or more different sized drug delivery bags 10 can be stored at the first station 110 for later use. The first station 110 can be in the form of a bin or the like or any other type of structure that can hold a number of drug delivery bags 10 of one type or different types.

The system 100 also includes a bag loading station 120 where the drug delivery bags 10 can be loaded onto a controllable transport mechanism or apparatus (device) 130 for the controlled movement of each drug delivery bag 10 from one location (one station) to another location (another station) and more specifically, the apparatus 130 can be in the form of a positional indexing apparatus that uses absolute encoder technology to track the position and location of specific points or areas/regions of the apparatus 130 or objects, such as the drug delivery bags 10, associated therewith as they are moved by operation of the transport apparatus 130. In the case of processing drug delivery bags 10, the apparatus 130 is constructed to advance, with positional precision, the loaded drug delivery bags 10 from and to various stations of the system 100.

Figure 7A:
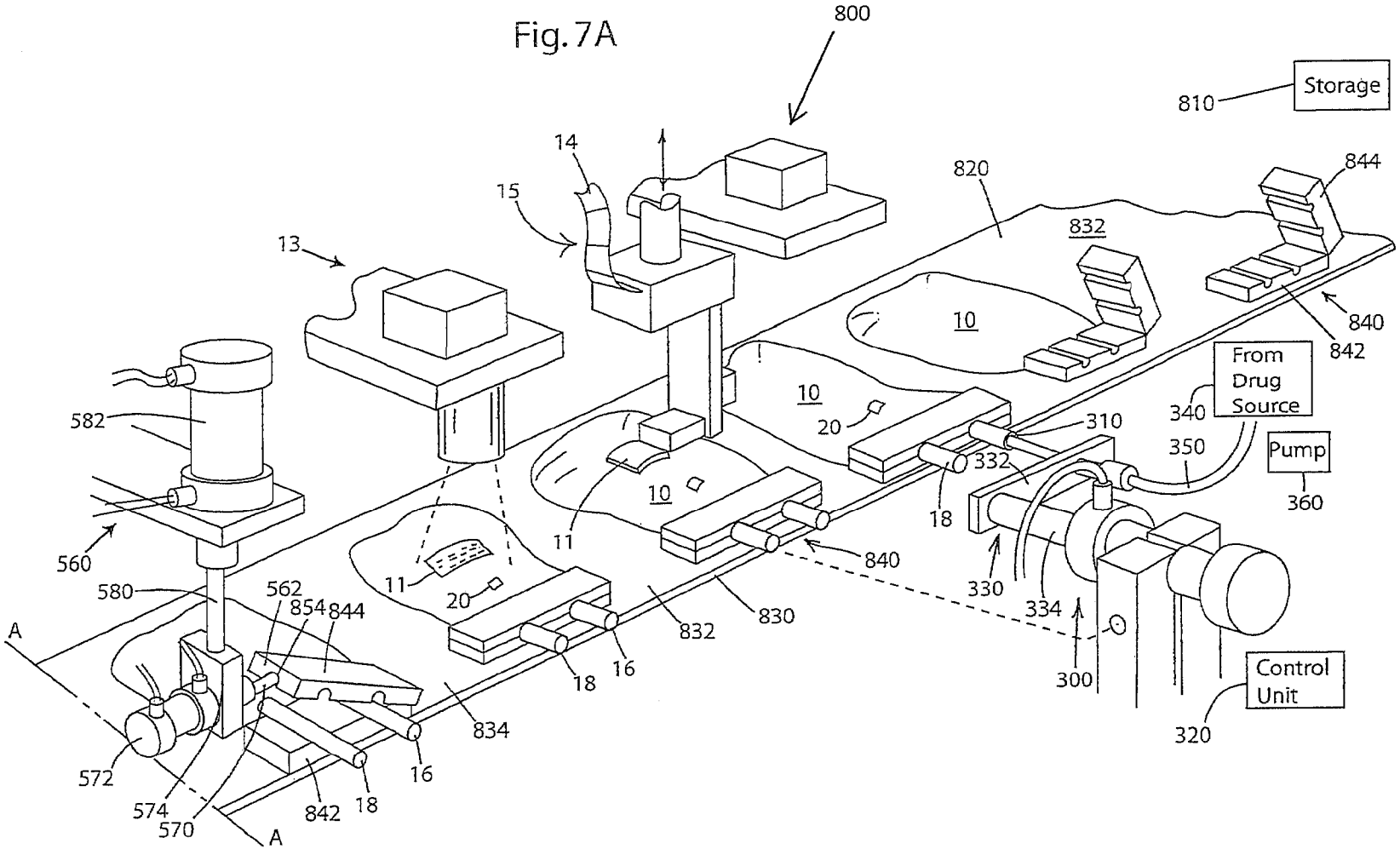
FIGS. 7A-7B are schematic perspective views of an automated drug delivery bag filling system according to a second embodiment.
Figure 7B:
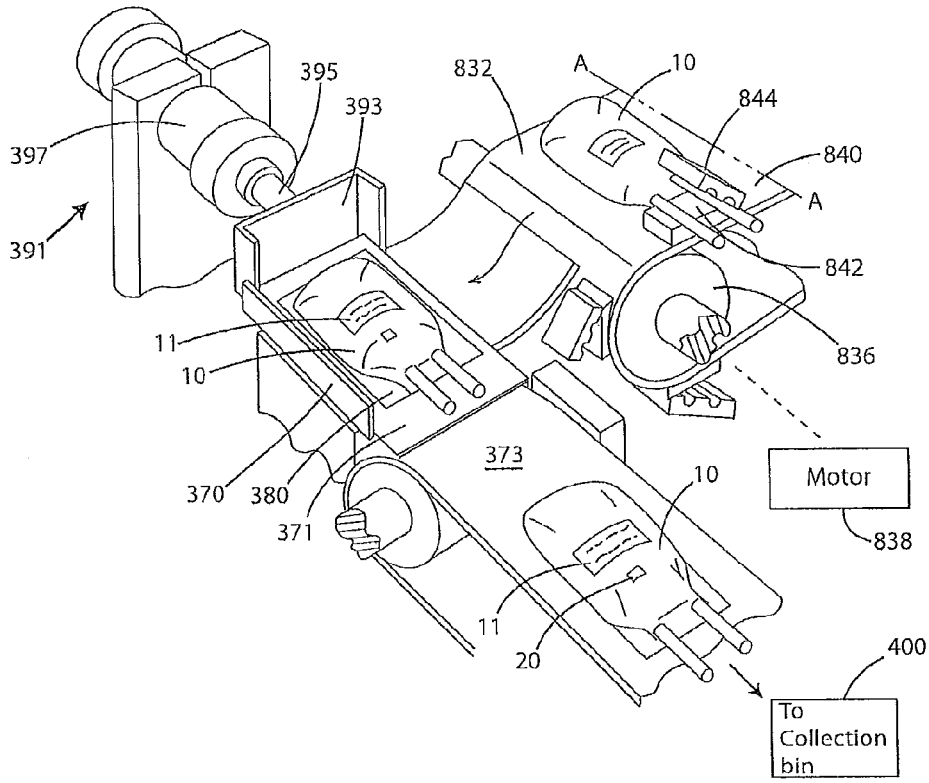
Figure 8:
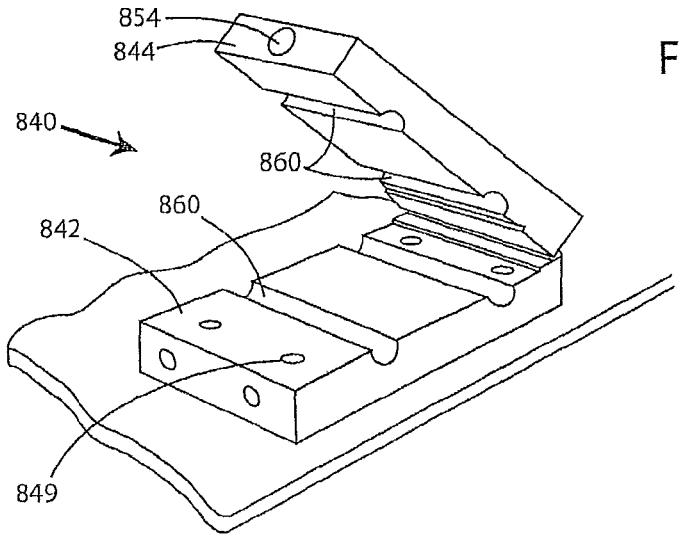
FIG. 8 is a perspective view of a bag carrier in an open position.
Figure 9:
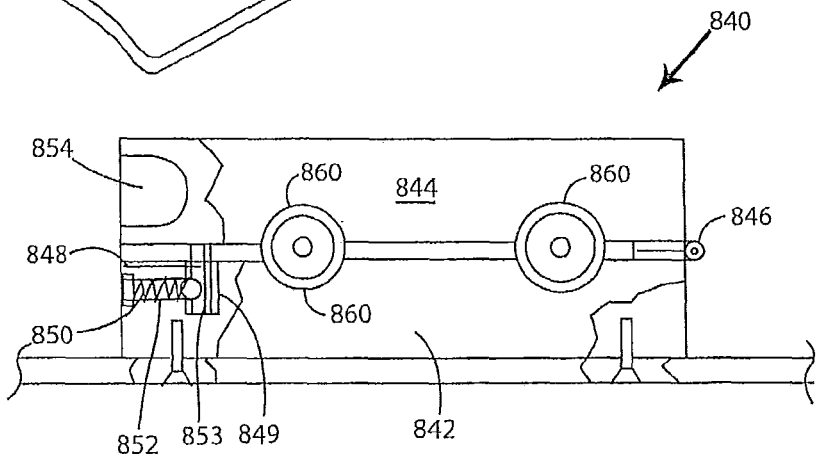
FIG. 9 is a cross-sectional view of the bag carrier of FIG. 8 in the closed position.

The loading station 120 can take any number of different forms and can either be a manually operated station or an automated station where drug delivery bags 10 are orientated and then delivered to a load location of the loading station 120 where the drug delivery bags 10 are then loaded onto the transport device 130 as described in detail below. In one embodiment and as shown in FIGS. 1A-1D, the drug delivery bags 10 are loaded so that they are vertically orientated with respect to one another and the ground; however, as shown in FIGS. 7A and 7B, the drug delivery bags 10 can be loaded so that they are horizontally orientated with respect to one another and the ground.

The drug delivery bag 10 typically includes a sealed body 12 defined by two sealed sheets of flexible material that defines an interior compartment or space 14 that holds the fluid that is to be dispensed to the patient. The drug delivery bag 10 includes two ports, namely, a first port 16 that is a port (fill port) through which fluid can be delivered into the interior compartment 14. The drug delivery bag 10 also includes a second port 18 that is an infusion port through which the fluid in the interior compartment 14 is delivered to the patient as by means of the infusion line and access device, etc. Each of the first and second ports 16, 18 can be any number of standard ports that permit attachment to another member, such as a conduit or line, in a sealed manner. Alternatively, the fill port can be in the form of an injection port mounted as a button on the side of the bag.

The transport device 130 preferably includes some type of retaining means or stabilizer or retainer which acts to securely hold the drug delivery bag 10 in a predetermined desired orientation as it is advanced by the transport device 130 from one location (one station) to another location (a next station). The precise shape and size of the transport apparatus 130, as well as its processing capabilities, can vary depending upon the specific application and environment in which the apparatus 130 is used. For example, the transport apparatus 130 can be in the form of a conveyor, similar to a dry cleaning conveyor, which includes a track 132 that defines a travel path of the bag 10 and can be in the form of a closed loop so that continual operation is possible. The conveyor 130 has a power supply 101, such as a motor, for driving the drug delivery bags 10 along the track 132 in a controlled manner (e.g., an indexed manner). The track 132 can be in the form of a U or C-shaped guide rail that includes one or more carriers 140 that are directly or indirectly coupled to the motor 101 to permit each carrier 140 to be driven within and along the track 132 and since one drug delivery bag 10 is attached to the carrier 140, the drug delivery bag 10 is moved along with the carrier 140 along the track 132. Additional details about the carrier 140 are set forth below. The conveyor 130 and in particular, the operative parts thereof, such as the motor 101, are in communication with the master controller of the system 100 to ensure that the entire system 100 is a fully integrated system. The carrier 140 can be advanced via the motor 101 in the guide track 132 by any number of conventional techniques, including the use of a driven member 137, such as a chain or a belt, that is attached to the carrier 140 and operatively coupled to the motor 101 and is driven along and within the track 132 to advance the carrier 140 from one station to the next station.

Figure 1A:
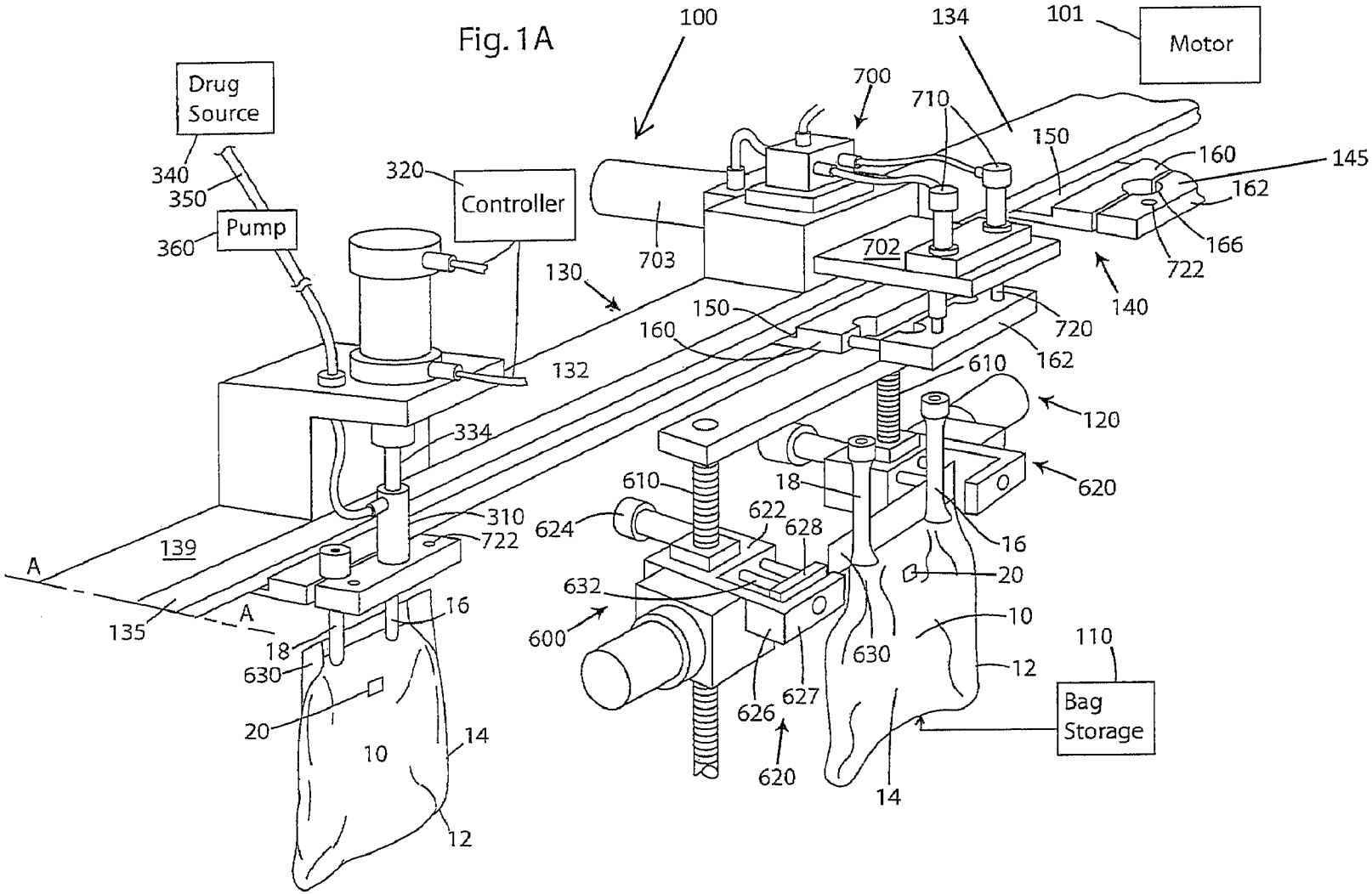
FIGS. 1A-1D are schematic perspective views of an automated drug delivery bag filling system according to a first embodiment.
Figure 1B:
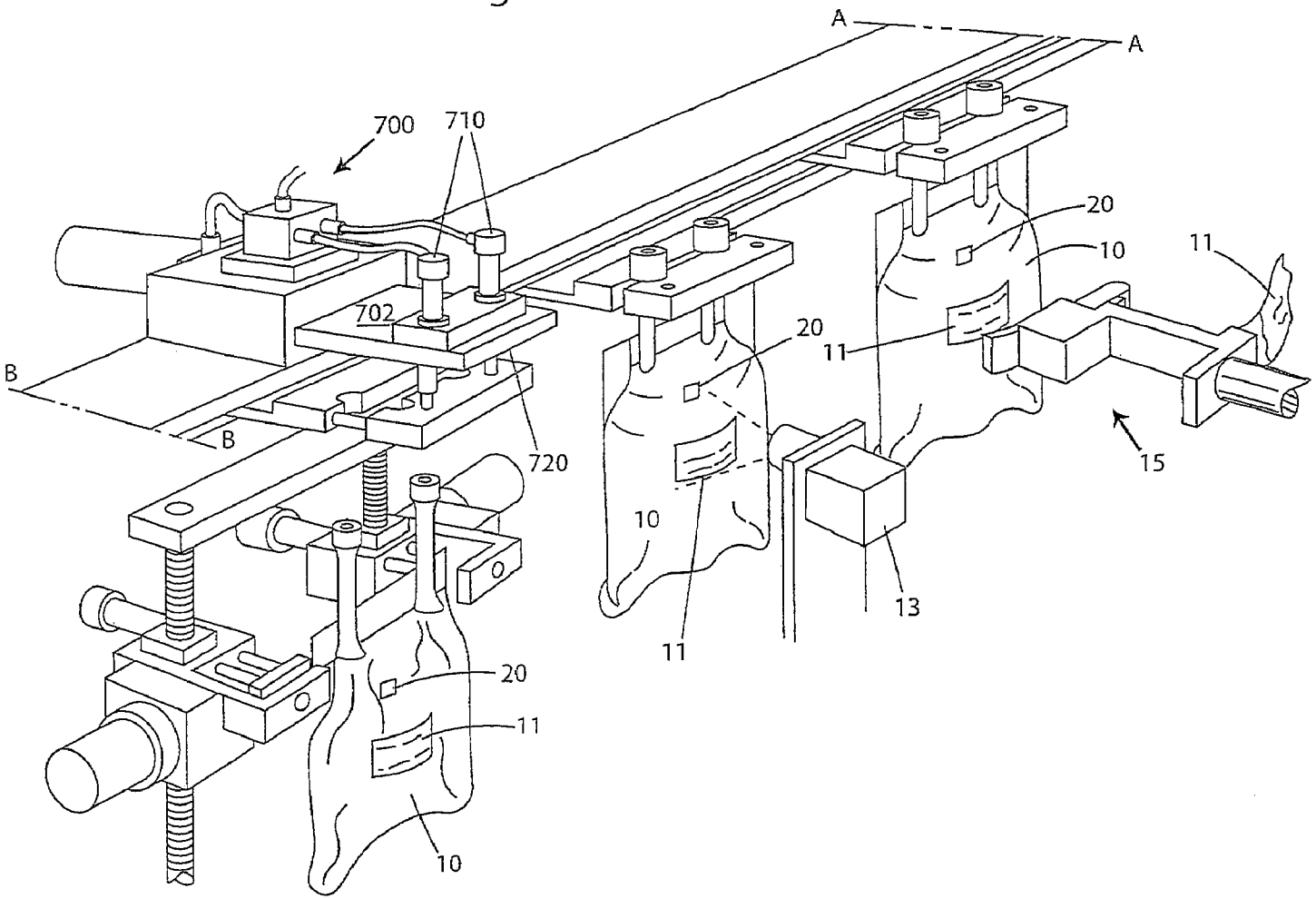
Figure 1C:
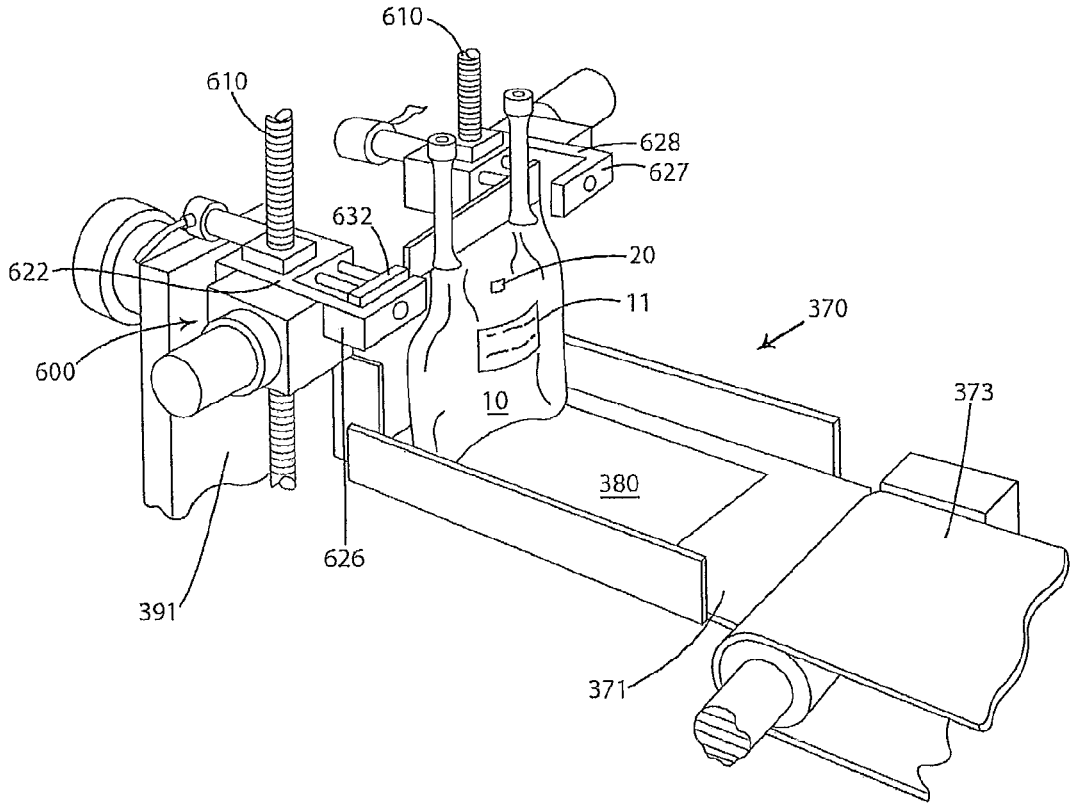
Figure 1D:
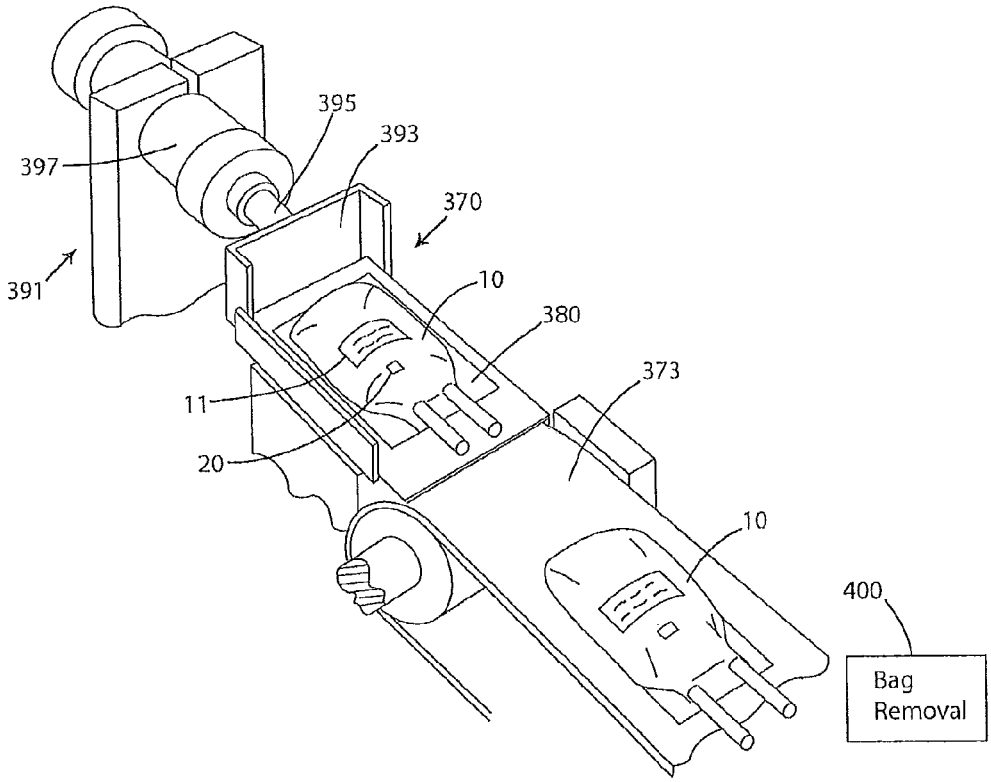

Regardless of the specific nature and design of the track 132 (e.g., whether it is a closed loop or an open loop that includes motorized rollers or a walking beam), the various stations of the system 100 are typically arranged around and relative to the track 132 so that as the drug delivery bag 10 is moved along the track 132 it is controllably delivered from one location to another location (e.g., one station to another station). For example and as shown in FIG. 1A, the loading station 120 is arranged near one end 134 of the track 132 and the other stations are formed along one or more linear segments of the track 132. While the track 132 has a generally linear design, the driven member 137 and the attached carrier 140 loop back to the loading station 120 after exiting the final station along the linear segment. It will be appreciated and understood that at the loading station 120, the drug delivery bag 10 is loaded by being coupled to the carrier 140 permitting the drug delivery bag 10 being held in a desired orientation (e.g., vertical) relative to the transport device (conveyor) 130.

FIGS. 1A-1D show one exemplary transport device 130 where the drug delivery bags 10 are held and advanced vertically along the track 132. The track 132 has a U or C shape and includes a longitudinal slot 133 formed in a side wall 135 thereof and extending along a length of the track 132 as shown. The driven member 137, such as a chain or belt or the like, is contained within the track 132 underneath an upper wall 139 and between the side walls 135 so that the track 132 serves to at least substantially enclose the driven member 137 for safety reasons so that the driven member 137 is not easily accessible to an operator of the system or some other individual. The driven member 137 includes a plurality of mounting structures 150 that are spaced apart from one another and are connected to the driven member 137 so that they move in unison with the driven member 137 as the driven member 137 is moved within the track 132. One mounting structure 150 is in the form of a bracket that attaches to the driven member 137 and extends through the longitudinal slot 133. As illustrated, the free end of the bracket 150 preferably extends beyond the outer edge of the side wall 135 and thus beyond the track 132. As illustrated in the Figures by extending the bracket 150 beyond the edge of the track 132, the drug delivery bag 10 can hang vertically and be outside of the track 132 so as not to interfere with the working components, such as the driven member 137, contained inside the track 132.

Preferably, the carrier 140 also serves as the retaining and stabilizing feature mentioned above. More specifically, the carrier 140 is configured so that it holds the drug delivery bag 10 in the desired orientation and, in addition, the first and second ports 16, 18 are held at specific, precise locations within the carrier 140 and this permits the precise coordinates of the first and second ports 16, 18 relative to the carrier 140 to be known.

In one embodiment, the carrier 140 is constructed to have a clamping action in that the carrier 140, in a first position (unlocked or unclamped position), has an opening, such as a slot, for receiving at least a portion of the drug delivery bag 10 and then the carrier 140 is moved to a second position, where the drug delivery bag 10 is securely held within the carrier 140 in the predetermined, desired orientation. When secured to the carrier 140, at least the first port 16 must be accessible and as is shown in FIGS. 1A-1D, when the drug delivery bag 10 is held within the carrier 140, the first and second ports 16, 18 are disposed above one face or surface 145 of the carrier 140 so as to be freely accessible. The carrier 140 will thus be formed to accommodate the first and second ports 16, 18 and can include slots or openings through which the first and second ports 16, 18 are received and held when the carrier 140 assumes the second locked or clamped position.

In the embodiment of FIGS. 1A-4, the carrier 140 is at least partially an integral part of the mounting structure 150 and in particular, is integral with the bracket 150 and therefore, when the driven member 137 moves within the track 132, the carrier 140 also moves in unison since it is attached to the driven member 137 by means of the mounting structure 150. The carrier 140 can be in the form of a clamp or the like in which the drug delivery bag 10 is inserted and securely held in a fixed orientation, with the first and second ports 16, 18 being at fixed locations relative thereto. Any number of different structures can be used to form the clamp design of the carrier 140. For example, the carrier 140 can be in the form of two sections or plates or blocks 160, 162 that are biased together in a rest position. In this arrangement, the block 160 is fixedly attached to the mounting structure 150, while the other block 162 is movable relative to the block 160 and to the mounting structure 150. The block 162 is normally biased by a biasing means 161 (e.g., spring biasing means) towards the block 160 but when a sufficient force is applied to the block 162, it can be separated from the block 160 so as to create a space that can receive at least a portion of the drug delivery bag 10. It will also be appreciated that the means 161 can be a simple mechanical gripper device that is pneumatically operated or electrically controlled as opposed to being spring biased.

In particular, the block 160 can include an inner surface that has a pair of recessed channels 166 (e.g., semicircular channels) formed therein and sized to receive the first and second ports 16, 18, respectively. The block 162 has a complementary design in that its inner surface has a pair of recessed channels 166 (e.g., semicircular channels) that mate with the channels 166 of the block 160 so as to form a circular shaped opening that can receive the first and second ports 16, 18, which typically are circular shaped tubes. The first and second ports 16, 18 are received in the recessed channels 166 so that the height of at least the fill port 16 above and relative to the upper surface of the blocks 160, 162 is fixed for each carrier 140. As described in more detail below, this provides uniformity in the automated system 100 since the drug delivery bag 10 is filled at a subsequent station.

The means for biasing the blocks 160, 162 with respect to each other can be accomplished in any number of different conventional ways. For example, the blocks 160, 162 can be spring biased, as shown, by biasing elements or other means, such as pneumatic means, can be used. The blocks 160, 162 are naturally biased closed so that an opening force has to be applied to the block 162 to cause it to open enough to insert the drug delivery bag 10 and position the ports 16, 18 into the recessed channels 166. Once the opening force is removed, the block 162 closes relative to the block 160 and the drug delivery bag 10 and further, the ports 16, 18 are captured within and between the blocks 160, 162. It will also be understood that the two blocks 160, 162 can alternatively be coupled to one another along a hinge that applies the closing biasing force that causes the drug delivery bag 10 to be captured and vertically and suspended and held therebetween. Once again, in all of the embodiments and when the drug delivery bag 10 is held within the carrier 140, the drug delivery bag 10 hangs vertically outside the track 132.

In the illustrated embodiment, the means for loading bag 10 into the carrier 140 includes a bag holder or gripper 600 and a device 700 for opening, as well as closing, the carrier 140. More specifically, the bag holder 600 includes a device that is vertically driven along guides 610, such as a pair of spaced vertical screw drive mechanisms, and contains a pair of actuatable gripping mechanisms 620 that hold the bag 10 therebetween. For example, the holder 600 can include a pair of main driven sections 622, each of which is driven along the respective guide 610 by means of a motor 624 or the like. The gripping mechanism 620 is coupled to and is part of the driven section 622 and includes a clamping arm 626 that can be formed of a stationary part 627 and a movable part 628 that is driven towards the part 627 to capture an ear section 630 of the bag 10 therebetween (closed position) so as to hold the bag 10 therebetween, or the part 628 is driven away from the part 627 to release the bag 10. The part 628 can be controllably moved by means of one or more pistons 632 that are controlled by a controller or the like. It will be appreciated that only one complete gripper mechanism 620 is shown in the Figs. since the other one is a mirror image in that the two gripper mechanisms 620 are spaced from one another such that the bag 10 is received therebetween and is held by the two ear sections 630 thereof. In this embodiment, the main sections 622 are driven vertically along the guides 610 and the movable parts 628 and pistons 632 are driven horizontally.

The device 700 is designed to either open or close the carrier 140 depending upon the state of the bag 10 and where the bag 10 is located. In the illustrated embodiment, the device 700 includes a body extension 702 that can be driven in a horizontal direction as by a controllable piston 703 or the like. The extension 702 includes a pair of drivable components 710, such as a pair of pistons, that can be driven in a vertical direction. The pistons 710 includes distal ends in the form of fingers or posts 720 that are designed to be received in complementary openings 722 formed in the block 162.

To open the carrier 140 that is normally biased closed, the carrier 140 is advanced to the location of the device 700 and is therefore underneath the extension 702 and then a controller or the like drives a motor to caused the pistons 710 to extend downwardly so that the posts 720 are received in the openings 722 and then the extension 702 is driven horizontally to an extended position so as to cause the blocks 160, 162 to open.

Once the blocks 160, 162 are open, the bag 10 is loaded by means of operation of the bag holder 600. The pair of main driven sections 622 is driven along the respective guide 610 by means of the motor 624 so as to position the ports 16, 18 of the bag 10 within the notches 166 of the blocks 160, 162. Once the bag 10 is in the proper position, the pistons 710 are operated so as to retract the posts 720 out of the openings 722, thereby permitting the biasing means 161 (springs) of the carrier 140 to release its energy and return to the normally closed position, whereby the bag 10 is captured between the closed blocks 160, 162. Since the bag 10 is now securely held by the carrier 140, the holder 600 can be opened to release its grip on the bag 10 and in particular, the movable parts 628 are backed away from the parts 627 so as to release the bag 10 and then the main sections 622 are retracted downwardly along the guides 610 until they clear the bag 10, thereby permitting the bag 10 to be advanced to the next station.

It will be appreciated that this procedure is reversed, as discussed below, after the bag 10 is filled so as to deliver the filled bag 10 from one station to another station. In other words, the filled bag 10 is gripped again by the holder 600 and then the device 700 is used to disengage the blocks 160, 162 of the carrier 140 to permit the bag 10 to be removed from the tack 132 and delivered to another station.

In yet another embodiment in FIGS. 5-6, the carrier 141 is detachably coupled to the mounting structure 150 and in particular, to the bracket 150. In this embodiment, the carrier 141 is applied and clamped to the drug delivery bag 10 prior to releasably interlocking the carrier 141 to the mounting structure 150. It will therefore be appreciated that in this embodiment, the carriers 141 can be attached to the drug delivery bag 10 at a location remote from the system 100 (e.g., the loading station 120). Thus, the carrier 141 can be preassembled with the drug delivery bag 10 and then at a later time, the carrier 140 with drug delivery bags 10 attached thereto are coupled to the mounting structure 150 by any number of different means, including a mechanical fit, magnetic means, etc. For example, the mounting structure 150 can include a first fastening feature and the carrier 141 can include a complementary second fastening feature such that mating of the first and second fastening features results in the carrier 141 being releasably attached to the mounting structure 150. As illustrated, the first fastening or coupling feature can be in the form of a slot 157 that is formed in the end of the bracket 150 that extends beyond the side wall 135 of the track 132 and receives a complementary tang, tab, or projection 159 that is part of and extends downwardly from the block 160. To releasably couple the carrier 141 to the mounting structure 150, the tang 159 is simply inserted into the slot 157 resulting in the carrier 141 being securely mounted to and hanging from the mounting structure 150. Alternatively, the first and second fastening features can form a snap-fit connection resulting in the carrier 141 being snap-fittingly interlocked with the mounting structure 150.

After the drug delivery bag 10 has been completely processed by the system 100, the carrier 141 can be manipulated to release the drug delivery bag 10 or the carrier 141 can be released from the mounting structure 150 and then opened up to release the drug delivery bag 10. Any other types of interlocking or fastening means can be used to securely attach the carrier 141 to the mounting structure 150.

In either embodiment, the carrier 140, 141 is thus designed to be clamped to the drug delivery bag 10 slightly above a neck 13 of the bag 10 and more particularly, the carrier 140, 141 receives and clamps to the elongate conduit structures that form the first and second ports 16, 18 so that a portion of the first and second ports 16, 18 extends above a face or surface of the carrier 140, 141 and is thus freely accessible to another piece of equipment, such as an automated medication transfer device as discussed below. In the above embodiments, the first and second ports 16, 18 are mechanically (e.g., frictionally) held within the recessed channels of the blocks with at least the distal ends of the first and second ports 16, 18 extending above the upper face of the carrier 140, 141. Preferably, the recessed channels or the like are constructed so that the lengths of the first and second ports 16, 18 that are permitted to extend above the upper carrier surface are regulated and are uniform from one carrier 140, 141 to the other carriers 140, 141.

In the case where the carrier 141 is separate from the mounting structure 150 and the system 100 in general, the carrier 141 does not have to be spring biased but instead the carrier 141 can include some type of disengageable lock mechanism that can be actuated to lock the carrier 141 with the drug delivery bag 10 being captured therein and at least the fill port 16 being held and accessible. It will thus be appreciated that the clamping operation can take place at the loading station 120 itself in that loose bags 10 can be fed to a clamping device that applies the carrier 141 to the drug delivery bag 10 which is then coupled to the track 132. Alternatively, the carrier 141 can be applied to the drug delivery bag 10 prior to the loading station 120 as at a remote location and then delivered to the loading station 120 where the carrier 140 is received within the track 132 as by being coupled to the mounting structure 150 that is connected to the driven chain or belt member 137 resulting in the carrier 141 being directly connected to the driven member.

It will be appreciated that the arrangement of the track 132 and the drug delivery bags 10 is such that the drug delivery bags 10 hang vertically such that the port 16 is upright and therefore, when fluid is delivered through the fill port 16 into the drug delivery bag 10, the fluid will flow by gravity and this reduces the need for additional pumping means for delivering the fluid to the drug delivery bag 10.

The transport device 130 is thus preferably in the form of a multiple station cam-indexing device that is adapted to perform material handling operations by using absolute encoder technology. The transport apparatus or conveyor is configured to have multiple stations positioned thereabout. The indexing/encoder aspects of the transport apparatus/conveyor permit it to be advanced at specific intervals (increments) and in particular, permits each loaded drug delivery bag 10 to be delivered to a precise location, such as a next station, where it is further processed, etc.

The system 100 also preferably includes one or more reading devices 13 that are capable of reading a label 11 or the like disposed on a sealed container containing the medication (e.g., a drug vial) or a label 11 associated with the drug delivery bag 10 or some other object that is applied at a label station 15. The label 11 is read using any number of suitable reader/scanner devices 13, such as a bar code reader, etc. Multiple readers 13 can be employed in the system at various locations to confirm the accuracy of the entire process or even to receive instructions that influence how an operation is to be performed.

For example, the system 100 is preferably configured such that a master controller thereof receives medication orders either manually or automatically. In other words, an operator can manually enter medication orders into the master controller (computer) or the master controller can electronically receive medication orders as by receiving the orders via the internet or the like or some other type of interface. Once the medication orders are received, the drug delivery bags 10 are loaded at loading station 120 into the transport device 130. Either prior to, during, and/or after loading the drug delivery bags 10, labels 11, such as barcodes, associated with the drug delivery bags 10 are read (e.g., scanned) using the reader 13 (e.g., scanner) to permit information contained on the label 11 (barcode) to be inputted and entered into the master controller, as well as permitting this read information to be compared to other stored information as in the case of checking the integrity of the loading process for safety reasons, etc.

In an initial reading (scanning) operation, the drug delivery bags 10 can simply be identified and since the system 100 and in particular, the transport device/conveyor thereof, is preferably an indexed system that uses encoder technology or uses laser guiding technology so that the bag 10 is delivered to precise locations, the specific load position of each drug delivery bag 10 is stored in memory in the master controller and is linked to the bag identifying information that is read from the barcode or the like from the bag 10. Thus, the master controller is able to monitor and track the location of each bag and know what type of bag is at each location due to reading the identifying information on the label 11.

According to another aspect of the present invention, the drug delivery device (bag) 10 can have a readable or readable/rewritable medium 20 that is associated therein and in particular is securely attached thereto. In one exemplary embodiment, the medium 20 is an integrated circuit, such as an RFID tag 20.

The RFID tag 20 includes a write/read memory for storing predetermined information and a built-in antenna for communicating with an RF reader/writer to permit information to be transferred to and stored in the memory of the RFID tag 20 and/or permits information stored in the memory of the RFID tag 20 to be read by the RF reader. More specifically, the RF reader can include an antenna for reading information stored in the RFID tag 20, e.g., by transmitting an RF interrogation signal to induce the RFID tag 20 to transmit its information to the RF reader which is detected by the antenna. The RFID tag 20 can be one of two different types in that the RFID tag 20 can be active (powered by an internal power source) or it can be passive (powdered by an RF signal transmitted from the RF reader).

The RFID tag 20 can be attached to the drug delivery device (bag) 10 using any number of techniques as described below and is intended to store information related to the medical product contained with the drug delivery bag 10 or can even contain information that relates to the drug delivery bag 10 itself. For example, the information in the RFID tag 20 can include product information, such as a serial number and/or a National Drug Code (NDC) associated with the medical product, a product name, a manufacturer's name, a lot number and/or an expiration date.

It will also be appreciated that other types of custom information can be contained in the RFID tag 20 and more specifically, the RFID tag 20 can contain a product identifier uniquely associated with one or more entries in a database that can be accessed to obtain information related to the medical product. In addition, the information in the RFID tag 20 preferably includes dosage information that identifies the amount and/or concentration of the medical product, and/or a patient identifier that identifies a patient that is intended to receive this particular medical product. It will further be appreciated that the RFID tag 20 can contain other useful information in that it can contain administration requirements, instructions for use, and/or product warnings, such as possible allergic reactions or adverse interaction of the medical product with other medical products.

The information contained in the RFID tag 20 can also contain information that is related to the drug delivery bag 10. For example, the manufacturer and identifying information, such as the size or capacity of the drug delivery bag 10, can be contained in the RFID tag 20. The identifying information can be in the form of a volume or capacity of the drug delivery bag 10. For example, bags come in different volumetric sizes and therefore, during an operation, such as transfer or filling of the drug delivery bag 10 with the drug product, as described in detail below, it is desirable to confirm that the drug delivery bag 10 is of the correct type before the medical product is delivered to the drug delivery bag 10.

The information can be written into the RFID tag 20 at any number of different locations and times and by different persons. For example, some of the information can be written into the RFID tag 20 by the manufacturer of the medical product and/or by the manufacturer of the drug delivery device 10 as in the case where the type and/or size of the bag 10 is written into the RFID tag 20.

The RFID tag 20 is preferably made thin and flexible to permit the RFID tag 20 to be attached to the drug delivery bag 10 so that it does not interfere with using the drug delivery bag 10.

Any number of different means can be used to attach or couple the RFID tag 20 to the drug delivery bag 10. For example, the RFID tag 20 can contain an adhesive layer and a protective, release backing or cover over the adhesive layer such that when the user is ready to attach the RFID tag 20, the protective cover is removed, thereby exposing the adhesive layer and then the adhesive layer is brought into contact with the surface of the drug delivery device 10. It will also be appreciated that the RFID tag 20 can be removably attached using a hook and loop type fastener. In another embodiment, the RFID tag 20 is at least partially encapsulated or embedded within the drug delivery bag 10. For example, the RFID tag 20 can be at least partially embedded within a wall of the drug delivery device 10 during the manufacture of the drug delivery bag 10.

In one aspect, the RFID tag 20 is removably attached such that the tag 20 is not simply discarded with the drug delivery bag 10 after use and this leads to cost savings. The releasable attachment of the RFID tag 20 can be accomplished in any number of different ways including the attachment techniques described above and the insertion of the RFID tag 20 in a sleeve or pocket or the like that is associated with the drug delivery bag 10. In yet another aspect that is described below in detail, the detachable RFID tag 20 is removed from the drug delivery bag 10, after the intended application is complete, and can be archived for later consultation. In other words, the RFID tag 20 can be placed in a log book and identified in the log book by some type of identifying information and if at a future date, there is a need to view the information contained in the RFID tag 20, the tag 20 is simply retrieved and its information is viewed.

It will also be appreciated that the process of affixing the RFID tag 20 to the drug delivery bag 10 can be performed either manually or it can be performed as part of an automated system where a robotic device or the like can attach the RFID tag 20 to the drug delivery bag 10. For example, the robotic device can include a reel of RFID tags 20 and adhesive tape with a backing, protective layer, with the device containing an automated means for removing the backing layer from the adhesive tape and then applying the RFID tag 20 to the drug delivery bag 10, e.g., to one side of the bag.

RFID tags 20 offer a number of advantages over conventional barcode tags. For example, the RFID tag 20 does not require a line of sight between itself and the RFID tag 20 to read the information in the RFID tag 20. In addition, the RF reader can read many RFID tags 20 at a time, while a barcode reader or scanner can only read one barcode tag at a time. Moreover, RFID tags 20 can be smaller, more accurate, more durable and are capable of storing more information than barcode tags. Another disadvantage related to the use of barcodes is that barcodes can only contain a limited amount of information as opposed to an RFID tag 20 that contain a vast amount of information.

In the case where the RFID tag 20 is a readable only tag, an RF reader is provided and in the more desirable application where the RFID tag 20 is a readable and rewritable medium, an RF reader/writer is provided. Further details about the RFID tag 20 are set forth below.

After the drug delivery bag 10 is loaded and depending upon which type of carrier or retaining type clamp mechanism is being used, the mechanism is closed so to securely position the bag 10 in a vertical position as described above.

The label 11 (e.g., barcode), RFID tag 20, or the like can then be read by the reader 13 for the purpose of performing a medication integrity check (safety check) prior to delivering the medication to the bag 10 and also to associate one particular identifiable syringe with a medication order. The bags 10 can be bought in empty bulk form with each bag having a specific identifier, such as a barcode, that differentiates one bag from another. By initially scanning or otherwise reading this identifier, one specific, easily identifiable and trackable, bag 10 is associated with one particular medication order.

Once this association is performed, it is possible to apply another label that contains information that permits a confirmation of the medication type and the dosage amount and dosage characteristics (e.g., concentration) against the inputted or received medication order that is associated with this particular bag. The inputted medication order includes not only information about the medication to be prepared, such as the medication product name, the dosage amount and concentration (and can include other information as well such as a flow rate (drip rate)), but also, the medication order contains identifying information that serves to link one particular bag 10 to an intended recipient which can be a specific patient or an entity, such as a hospital, an institution, etc. For example, the inputted information likely contains a unique identifier, such as a patient number (e.g., social security number), that serves to identify whom the medication is for and where it is to be delivered.

In the instance where the label 11 contains medication identifying information, the reader 13 thus reads the label 11, as by scanning the barcode 11, prior to delivering the medication into the bag 10 to determine drug and patient identifying information and then compares this information to the inputted information stored in the system memory. For example, the inputted information can list a patient identifier as 301-56-9567 and indicate that a 50 ml bag of cyclophosphamide of a given concentration (e.g., 10%) is to be prepared and this information is then compared with information that is read from the bag 10 by the reader. If the information read from the label 11 matches the information stored in memory (e.g., in a database), then the bag 10 is advanced to the next station (a drug delivery station 300) by means of the transport device 130. If the information does not match as would be the case if either the patient identifiers did not match and/or if the read product identification information (such as the drug name and/or dosage information) did not match the stored information, then the operator is alerted to this discrepency and the bag 10 is not advanced to the next station. Remedial action, such as removing the bag 10, can be taken. Since the system 100 and in particular, the transport device 130, moves in an indexed manner, the system 100 is able to track each loaded drug delivery bag 10 along the entire course of the track 132 and therefore, the system 100 knows which bag 10 is in each station or about to be delivered to a station. For example, it is possible that a plurality of bags 10 can be located in between stations in que for entry into the next station, such as the drug delivery station 300; however, the system 100 easily tracks the precise location of the bags 10 and in this case, their order in the que and thus, when the transport device is incrementally advanced, the system continuously updates the positions of the bags 10 and is thus able to track and detect when a bag 10 is entering a new station prior to an operation being performed on the bag 10, such as filling the bag 10 with medication.

In FIGS. 1A-1D, the reader 13 and a labeling station 15 for applying the label 11 are illustrated as being downstream from the drug delivery station 300; however, while this location is a suitable location to perform safety and to confirm the accuracy of the fill, one or more of the reader 13 and the labeling station 15 can be located upstream from the drug delivery station 300 as described below even though this particular location is not illustrated in the FIGS. 1A-1D. For purposes of brevity, the reader 13 and labeling station 15 are illustrated as being downstream of the drug delivery station 300; however, they can instead be located upstream of the station 300 or there can be two sets of devices, one located upstream of station 300 and one located downstream of station 300.

The bag 10 is then advanced to the drug delivery station 300 where a predetermined amount of medication is delivered through the fill port 16 and into the bag 10. Any number of different means can be used for delivering the medication through the fill port 16 of the bag 10 with the necessary precision such that a prescribed amount of medication is delivered to the bag 10.

FIGS. 1A-1D illustrates one exemplary delivery station 300 that includes an automated, controllable drug transfer member 310 that is constructed to mate with the fill port 16 to permit delivery of medication from the drug transfer member 310 and through the fill port 16 into the interior of the bag 10. A seal should be formed between the drug transfer member 310 and the fill port 16 to ensure a complete and accurate transfer of medication into the bag 10. One exemplary drug transfer member 310 is a drug delivery needle (cannula) that includes a first end in the form of a sharp tip that is designed to pierce a rupturable septum that is part of the fill port 16. When the needle end pierces the septum, it can inject a controlled amount (dosage) of medication through the fill port 16 and into the bag 10 and since in some embodiments, the bag 10 is hung vertically, the injected medication flows by gravity into the interior of the bag 10. As is known, once the needle is removed from the fill port 16, the septum reseals itself.

It will also be understood that in another embodiment the needle end can include a connector or fitting or the like that mates with a similar structure on the end of the fill port 16 to create a sealed connection therebetween. This likewise permits the medication to be delivered into the interior of the bag 10.

It will be observed that the insertion of the needle into the fill port 16 requires a high level of precision with respect to the location of the fill port 16 and the needle and more particularly, requires the needle to be axially aligned with the fill port 16 so that when the needle is controllably advanced as described below, it engages and enters the fill port 16. The use of a carrier, such as carrier 140, permits the fill port 16 to be held at a known, fixed location relative to the carrier structure itself and therefore, when the carrier or stabilizer is advanced to the station 300 in an indexed manner by means of the master controller, the location of the carrier in the station 300 is known and controlled. As a result, since the location of the fill port 16 relative to the carrier is known, the overall location (coordinates) of the fill port 16 within the station 300 is known and this permits the system 100 to be constructed so that the needle is advanced to this target location where the fill port 16 resides to permit engagement therebetween. As previously mentioned, the carrier also preferably regulates the length of the fill port 16 that extends beyond the carrier and therefore, the needle is automatically delivered to a proper location in that it does not extend either too far into the fill port 16 or not enough such that it is not in engagement with the fill port 16. In the case where the bag 10 is held vertically, the needle is moved in a downward direction toward the inverted bag 10 until the needle engages and sealingly mates with the fill port 16. The use of the carrier 140 not only stabilizes and holds the bag 10, more particularly the fill port 16 thereof, such that the needle can be inserted therein, but also, the carrier serves to fixedly locate the fill port 16 and permit other components, such as the needle, to be driven to known coordinates at various stations for performing an operation on the fill port 16 (e.g., delivering medication).

As shown in FIGS. 1A-1D, the needle is of the type that includes a needle engagement control unit 320 or some other type of means for moving the needle in a controlled manner and in a controlled direction. The control unit 320 includes a controller that is in communication with the master controller of the system 100. The control unit 320 can be in the form of a reciprocating piston 334 that is operably connected to the motor as by a drive shaft etc., such that when the motor is operated, the piston 334 is driven to an extended position that causes the needle to be driven toward and into engagement with the fill port 16 and conversely, when the motor is operated again, the piston 334 is driven to a retracted position to cause the needle to be withdrawn (disengaged) from the fill port 16 and thus, permit the filled bag 10 to be advanced to a next station.

By having the controller in communication with the master controller, all of the events relating to the operation of the system 100 are able to be coordinated and more specifically, the motor of the unit 320 is timed so as to operate only after a new empty bag 10 has been delivered to the fill location of the station 300.

The drug delivery station 300 also includes a drug source 340 that contains a predetermined amount of a drug of a given type (product and dosage). For example, the drug source 340 can be in the form of a drug bag or a drug vial and in particular, the drug source can be hung vertically so that it can flow by gravity to another location, such as the needle for delivery to the bag 10. It will be appreciated that the operator can easily and readily change the drug source 340 based on the filling needs since the bags 10 likely require different medications and/or different concentrations of the same drug and therefore, different drug sources 340 are needed to be loaded and connected to the control unit 320 for delivery to the bags 10. In the illustrated embodiment, the drug source is in the form of a drug bag 340 (infusion bag) and the infusion port 18 is used to deliver the drug to the needle.

A conduit 350 is sealingly attached at a proximal end to the drug source 340 and an opposite distal end is sealingly attached to the needle to permit the drug stored at source 340 to be delivered to the needle. When the drug source 340 is a drug delivery bag, the proximal conduit end is attached to the infusion port 18. The conduit 350 is typically a tube or the like that carries the drug from the source 340 to the needle. Along the path of the conduit 350, a pump mechanism or the like 360 is preferably disposed for controllably moving the drug from the source 340 to the needle. The pump mechanism 360 is in communication with the controller to permit the pump mechanism 360 to be controlled such that a predetermined amount of medication can be pumped through the conduit 350 and into the needle and then into the bag 10. For example, the pump mechanism 360 can be operated only when the needle is in an extended position and in engagement with the bag 10. Any number of different types of pump mechanisms 360 can be used including peristaltic pumps, motorized pumps, etc.

It will be appreciated that the fill instructions from the master controller to the controller depend upon the medication order for the particular drug delivery bag 10 that is present in the station 300 and ready to receive a dosage of medication. In other words, the master controller will send dosage fill instructions to the controller that in turn controls operation of the pump mechanism 360 based on the dosage fill instructions. The pump mechanism 360 is operated in such a way (e.g., turned on for a prescribed time period and/or run at a prescribed speed) that the predetermined desired amount of medication is dispensed through the needle into the bag 10. For example, if the instructions are to inject 50 ml of medication into the bag 10 the pump mechanism 360 operates differently than if the fill instructions are to inject 100 ml of medication into the bag 10.

A fluid (medication) transfer device identical or similar to that disclosed in commonly assigned U.S. Ser. No. 10/821,268, which is hereby incorporated by reference in its entirety, can be used at the medication delivery station and in combination with needle. The fluid transfer device is a spike-like instrument that includes a first section for piercing the septum of the fill port and a second section for sealingly yet releasably mating with the fluid delivery device (needle). The transfer device has a first channel extending through the first and second sections for carrying the medication and a second channel that is in fluid communication with a vent that is formed as part of the transfer device to permit air to flow into the fill port.

As mentioned above, the fluid transfer device can be readily changed and replaced with another (the same or different type), and in addition, the conduit 350 can likewise be changed depending upon different parameters and needs, including the volume of medication to deliver to the bag 10.

After the medication has been delivered to the bag 10 and the medication transfer operation has been completed, the needle is withdrawn and moved to the retracted position and the filled bag 10 is preferably then subjected to a process that checks the integrity of the medication transfer process. Not only can this include reading or scanning a bar code to again check the accuracy of the fill and placing another label on the bag, by the devices described above, but also, it can include a fill dose verification by weight process. This weight verification step can be performed at a separate station 370 from station 300 or it can be a substation that exists within the station 300. In either case, the filled bag 10 is set on a scale or the like or some other device 380 for measuring the mass (weight) of the filled bag 10. The target weight of the filled bag 10 is stored in memory of the master controller and thus, the measured weight can easily be compared to the target weight and if the measured weight is within an acceptable range then the bag 10 is advanced to a next station. However, if the measured weight of the filled bag 10 falls outside of the acceptable range, then the operator is notified and the master controller can take appropriate action which can be in the form of preventing the bag 10 from being advanced to the next station. The operator can be notified of the discrepancy in the measured weight by the automated process and then manual verification techniques can be used to determine if the weight of the filled bag 10 is within an acceptable range.

It will also be appreciated that the weight verification step can include acquiring and recording a tare weight on the empty bag 10 and then using the delta in weight (empty vs. filled) to verify that the correct amount of fluid was injected into the bag 10.

In one exemplary embodiment illustrated in FIGS. 1A-1D, the bag 10 is introduced to the station 370 by first releasing or ejecting the bag 10 from the carrier 140 using the devices 600 and 700 which serve to first grip the filled bag 10 by means of the holder 600 (e.g., gripping mechanisms 620 thereof) and then the device 700 serves to disengage and separate the block 162 from the block 160 of the carrier 140, thereby releasing the bag 10 from being captured therebetween. The bag 10 is held by the holder 600 and is then delivered to the 370 by either driving the main sections 622 of the device 600 along the vertical guides 610 and then releasing the gripping mechanism 620 to cause the bag 10 to fall by gravity onto a transport element. As illustrated, the bag 10 can be dropped onto a ramp structure 371 which delivers the bag 10 to the station 370 and in particular onto the scale 380 where the weight of the bag 10 can be calculated.

Once the filled bag 10 is approved for final distribution, whether or not the bag 10 was subjected to the optional weight verification station 370, the filled bag 10 is delivered to another station by means of a transport device, such as conveyor 373. Any number of techniques and mechanisms can be used to advance the filled bag 10 from the station 370 (e.g., from the scale 380) to the next station. In the illustrated embodiment of FIGS. 1A-1D, an actuatable drive member 391 is provided for selectively contacting and moving the bag 10 off the scale 380 and onto the conveyor 373. For example, the drive member 391 can be in the form of an extendable/ retractable plow member 393 that is driven by means of a reciprocating piston 395 by means of a motor 397. When the drive member 391 is driven into an extended state, the plow member 393 contacts and drives the bag 10 off of the scale 380 and onto the conveyor 373.

The filled bag 10 is preferably subjected to a labeling process in which a final label 11 is applied to the bag 10 at a labeling station 15 that contains a printer for printing the label 11 and a device for applying the printed label to the surface of the bag 10. The final label 11 includes all relevant information including patient identification information and product identification information, including dosage related information. Additional information can be included on the label 11 and while the label typically includes barcode information, other written information can be written on the label 11.

As part of the final product verification process, the final label 11 can be read (e.g., scanned) to verify that the label 11 contains the correct information and is otherwise complete. For example and in the case of barcode encoded information, a scanner can be used to read the barcode information and then compare this read information to information that is stored in the memory (e.g., the inputted medication order) to determine if any discrepancies exist within the patient identification information and/or the product identification information (dosage information). If a discrepancy exists, the master controller alerts the operator and either takes active remedial steps, such as rejecting the bag 10 and delivering it to another station for manual inspection, or prevents the rejected bag 10 from advancing to the next station and allows the operator to remove the rejected bag 10. This verification process preferably occurs at or near the labeling station 15; however, it can be at a separate station if desired.

It will also be appreciated that if the bag 10 has an RFID tag 20 attached thereto, then the tag 20 can be read instead of a barcode for purpose of verifying the that product in the bag 10 is the correct one and in particular, the information written in the RFID tag 20 is compared to the information stored in memory to see if there are any discrepancies between the two sets of information, such as weight differences.

This final read operation (verification operation) also can serve the purpose of logging data concerning the completion of the drug filling process. For example, a date and time can be logged for each bag 10 once the information contained in the barcode or RFID tag 10 is verified and before it is moved to the next station and then is discharged from the system 10 and delivered to a target location.

The bag 10 is then delivered to a bag removal station 400 where the bag 10 is removed from the transport device 830. Any number of different bag removal mechanisms 4 can be used to remove the filled bag 10 from the transport device 830 and permits the bag 10 to be delivered to another location, such as to a bag collector. It will be understood that the bag removal process can either be a manual operation, a partially manual operation or a completely automated process. When the bag removal device is at least partially automated, the device can be a robotic device that includes a robotic arm that is configured to be moved into position and grasp the filled bag 10 and then remove it from the transport device 130 with or without a carrier or stabilizer attached thereto. The robotic arm can have a gripper or the like for grasping and holding either the carrier or stabilizer directly or the bag directly. After grasping the carrier/stabilizer or the bag, the robotic arm then is moved so that the filled bag is located above or near a collection bin, container, or the like and then the filled bag 10 is deposited therein.

It will also be appreciated that a reader can be installed at the bag removal station 400 for the purpose of recording and confirming that the filled bag has been deposited into a target member, such as a bag collector. Once again, since the system 100 and in particular, the transport device 130, operates with high precision indexed movement, the master controller knows at any particular point in time which filled bag 10 is entering the bag removal station and thus, like the other reading operations, the reader reads the identifying information (patient and/or product identification information) and compares it to the stored information and if any discrepancy exists, the operator is notified so that remedial action can be taken.

FIGS. 7A-7B illustrate another exemplary automated system 800 for receiving, handling and filling drug delivery devices 10 which are in the form of intravenous containers (infusion devices), particularly drug delivery bags. The automated system 800 is divided into a number of stations where a specific task is performed based on the automated system 800 receiving user input instructions, processing these instructions and then preparing unit doses of one or more medications in accordance with the instructions. For purpose of illustration only, the present invention will be described in terms of the handling and processing of drug delivery bags (IV bags) 10; however, it will be appreciated that other drug delivery devices, such as a drug package, a container, etc., can equally be used and integrated into the present system 800.

The automated system 800 includes a first station 810 where empty drug delivery bags 10 are stored. It will be appreciated that the first station 810 can store a number of drug delivery bags 10 of different sizes (e.g., infusion bags having different maximum volumes). As a result, one or more different sized drug delivery bags 10 can be stored at the first station 810 for later use. The first station 810 can be in the form of a bin or the like or any other type of structure that can hold a number of drug delivery bags 10 of one type or different types.

The system 800 also includes a bag loading station 820 where the drug delivery bags 10 can be loaded onto a controllable transport mechanism or apparatus (device) 830 for the controlled movement of each drug delivery bag 10 from one location (one station) to another location (another station) and more specifically, the apparatus 830 can be in the form of a positional indexing apparatus that uses absolute encoder technology to track the position and location of specific points or areas/regions of the apparatus or objects, such as the drug delivery bags 10, associated therewith as they are moved by operation of the transport apparatus. In the case of processing drug delivery bags 10, the apparatus 830 is constructed to advance, with positional precision, the loaded drug delivery bags 10 from and to various stations of the system 100.

The loading station 820 can take any number of different forms and can either be a manually operated station or an automated station where drug delivery bags 10 are orientated and then delivered to a load location of the loading station 820 where the drug delivery bags 10 are then loaded onto the transport device 830 as described in detail below. In one embodiment and as shown in FIGS. 7A-7B, the drug delivery bags 10 are loaded so that they are loaded so that they are horizontally orientated with respect to one another and the ground.

The transport device 830 preferably includes some type of retaining means or stabilizer that acts to securely hold the drug delivery bag 10 in a predetermined desired orientation as it is advanced by the transport device 830 from one location (one station) to another location (a next station). The precise shape and size of the transport apparatus, as well as its processing capabilities, can vary depending upon the specific application and environment in which the apparatus is used. For example, the transport apparatus 830 can be in the form of a conveyor 832 and in particular, according to this embodiment and in contrast to the previous embodiment, the drug delivery bags 10 lay flat horizontally and a conveyor 832 is used for moving the drug delivery bags 10 from one location (station) to another location (station) as illustrated in FIGS. 7A-7B. In this embodiment, the conveyor 830 can be in the form of a flat horizontal conveyor that includes a movable support surface 834, such as a belt or the like, for transporting the drug delivery bags 10 along a linear horizontal path to downstream locations (stations). The illustrated conveyor 832 is formed of a spaced endless belt that is disposed around and driven by two drive rollers 836 that are spaced apart a predetermined distance. As is known, the endless belt 832 is fitted around the drive rollers 836 with an outer surface 834 of the belt 832 facing outwardly. The conveyor 832, its components, and its operation are conventional and therefore are not described in great detail. For example, the drive rollers 836 preferably are in the form of wheels, where at least one of the wheels is operatively coupled to a respective drive shaft (partially shown) which in turn is operatively connected to a motor 838 or other type of drive unit that permits the controlled advancement of the endless belt 832. The drive rollers 836 can include features formed as a part thereof for securely engaging the endless belt 832 so that it can be advanced without slippage.

In one embodiment, the width of the belt 832 is greater than the length (height) of the drug delivery bag 10 and therefore, the drug delivery bag 10 can lie on the belt 832 such that its complete area is supported by the belt 832. However, it will be appreciated that a portion of the drug delivery bag 10 opposite the ports 16, 18 can extend beyond and over one edge of the endless belt 832.

Similar to the embodiment illustrated in FIGS. 1A-1D and described above, a number of stabilizing/retaining features 840 are provided for securely locating and coupling the drug delivery bag 10 to the endless belt 832. As with the previous embodiment, the retaining feature 840 can either be at least partially an integral part of the endless belt 832 or it can be a separate part that is disengageably attached to the belt 832. The stabilizer 840 serves not only to fixedly attach the drug delivery bag 10 to a prescribed location of the endless belt 832 but it also serves to fixedly located the ports 16, 18, especially the fill port 16, at prescribed known coordinates so that when the stabilizer 840 is delivered to any of the stations of the system 100, the location of the fill port 16 is known and therefore, a piece of equipment, such as a fluid transfer device, can be brought into engagement with the fill port 16 to perform an intended operation, such as filling the drug delivery bag 10 with medication. It will be seen from FIGS. 7A-7B that when the drug delivery bag 10 lies horizontally across the belt 832, the fill port 16 is not oriented vertically relative to the upper surface of the belt 832 but instead the fill port 16 is oriented parallel to the upper surface of the belt 832. Thus, in this embodiment, gravity can not be exploited to assist in filling the drug delivery bag 10.

FIGS. 7A-7, 8 and 9 show the stabilizer 840 as an integral part of the upper surface of the endless belt 832 and in particular, the stabilizer 840 provides a clamping action in that the stabilizer 840, in a first position (unlocked or unclamped position), has an opening, such as a slot, for receiving at least a portion of the drug delivery bag 10 and then the stabilizer 840 is moved to a second position, where the drug delivery bag 10 is securely held within the stabilizer 840. Any number of different structures can be used to form the clamp design of the stabilizer 840 and for example, the stabilizer 840 can be in the form of two sections or plates or blocks 842, 844 that are biased together in a rest position. In this arrangement, the block 842 is fixedly attached to the upper surface of the belt 832, while the other block 844 is movable relative to the block 842. The block 844 can be biased (e.g., spring biased) against the block 842 but when a sufficient force is applied to the block 844, it can be separated from the block 842 so as to create a space that can receive at least a portion of the drug delivery bag 10.

For example, the blocks 842, 844 can be biased against one another by means of a biasing element 846, such as a spring or hinge structure, and the stabilizer 840 can contain a mechanism to assist in keeping the blocks 842, 844 in the closed position. For example, the mechanism can include a pin 848 that extends downwardly from the block 844 at one end thereof and is received in complementary openings 849 of the block 842 and a biasing element 850 is contained in a slot or opening 852 of the block 842 that is in communication with one opening 849. At the end of the biasing element 850, a ball like structure is formed and is received in a complementary dimple or recess 853 formed in the pin 848 when the two are aligned with one another, which occurs when the block 844 is closed relative to the block 842. In other words, the biasing element 850 is normally in the extended position and protrudes into the opening 849 at least partially; however and as the block 844 is closed, the pin 848 makes contact with the element 850 and overcomes its biasing force to cause it to retract slightly in its opening 852 to permit the pin 848 to travel in the opening 849 until the element 850 (ball portion thereof) is aligned with the recess 853 at which time, the element 850 enters this recess 852 and thereby provides some locking of the block 844 relative to the block 842. To separate the blocks 842, 844, the block 844 is simply lifter as by placing a member in a lift notch 854 formed in a side wall of the block 844 and as the block 844 is lifted, the biasing force of the element 850 is overcome and the ball portion released from the recess 852, thereby breaking the locking action of the mechanism.

According to one embodiment, the block 842 can include an inner surface that has a pair of recessed channels 860 (e.g., semicircular channels) formed therein and sized to receive the first and second ports 16, 18, respectively. The block 844 has a complementary design in that its inner surface has a pair of recessed channels 860 (e.g., semicircular channels) that mate with the channels 860 of the block 842 so as to form a circular shaped opening that can receive the first and second ports 16, 18, which typically are circular shaped tubes. The first and second ports 16, 18 are received in the recessed channels 860 so that the height of at least the fill port 16 relative to a side face of the blocks 842, 844 is fixed for each stabilizer 840. As described in more detail below, this provides uniformity in the automated system 800 since the drug delivery bag 10 is filled at a subsequent station.

The means of biasing the blocks 842, 844 with respect to each other can be accomplished in any number of different ways. For example, the blocks 842, 844 can be spring biased or other means, such as pneumatic means, can be used. The blocks 842, 844 are naturally biased closed so that an opening force has to be applied to the block 844 to cause it to open enough to insert the drug delivery bag 10 and position the ports 16, 18 into the recessed channels 860. Once the opening force is removed, the block 844 closes relative to the block 842 and the drug delivery bag 10 and in particular, the ports 16, 18 are captured within and between the blocks 842, 844. It will also be understood that the two blocks 842, 844 can be coupled to one another along a hinge that applies the closing biasing force to permit the drug delivery bag 10 to be captured and horizontally held therebetween. Any other number of biasing means or other mechanical mechanisms can be used to cause the drug delivery bag 10 to be held and stabilized relative to its movements relative to the conveyor belt 832. When the block 842 is fixedly attached to the conveyor belt 832, the block 842 can be attached using any number of different techniques, including using fasteners or the like.

Figure 10A:
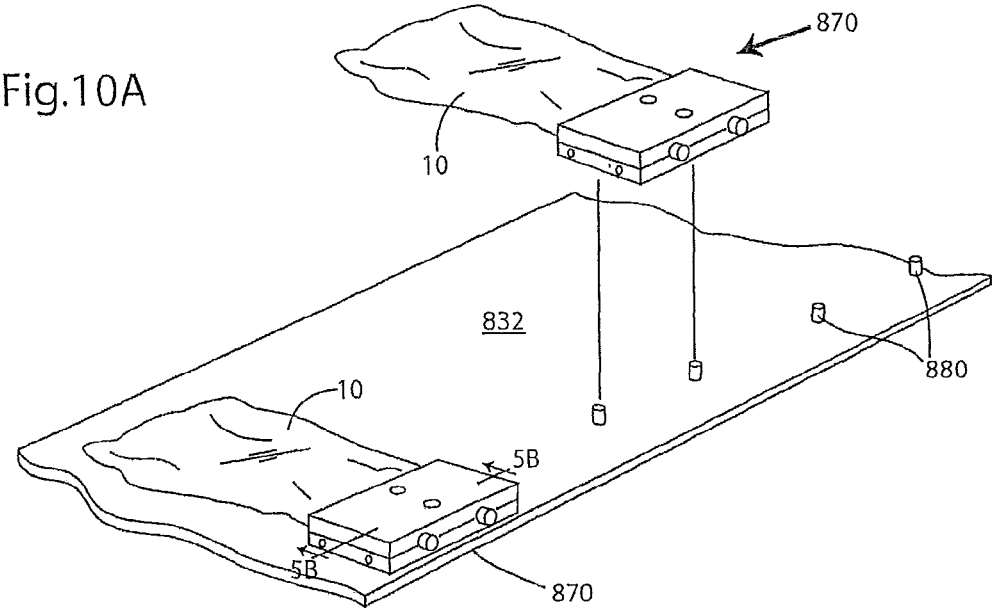
FIG. 10A is a perspective view of a releasable, independent bag carrier according to a second embodiment for being coupled to a surface of the transport device.
Figure 10B:
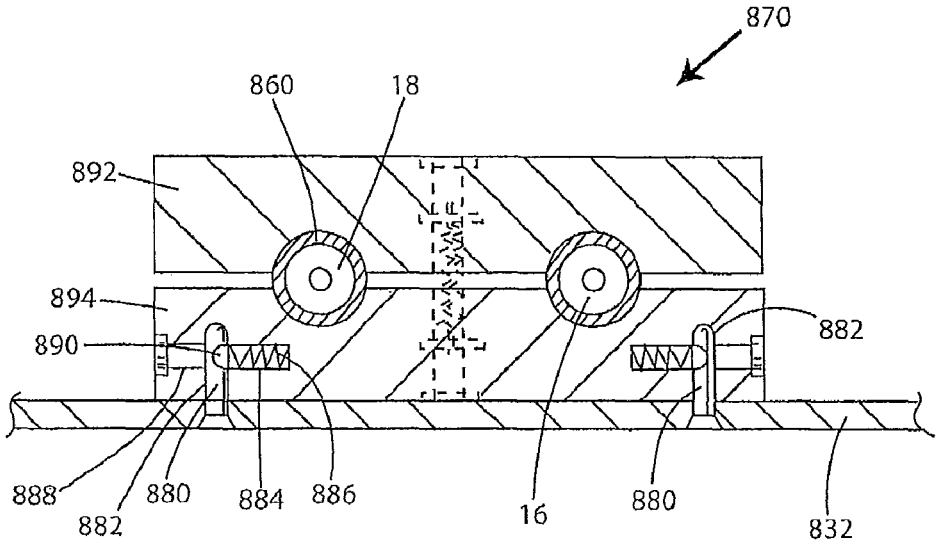
FIG. 10B is a cross-sectional view of the carrier of FIG. 10A.

As with the previous embodiment, the stabilizer does not have to be at least partially integrally attached to the upper surface of the conveyor belt 832 but instead a stabilizer 870 can be in the form of a structure that is detachably coupled to the upper surface of the conveyor belt 832. This embodiment is shown in FIGS. 10A-10B. It will therefore be appreciated that in this embodiment, the stabilizer 870 can be attached to the drug delivery bags 10 at a location remote from the system 100 (e.g., the loading station 120). Thus, the stabilizer 870 can be preassembled with the drug delivery bags 10 and then at a later time, the stabilizers 870 with drug delivery bags 10 attached thereto are merely coupled to the upper surface of the conveyor belt 832 by any number of different means, including a mechanical fit, magnetic means, etc.

For example, the upper surface of the conveyor belt 832 can include a first fastening feature 880, such as upstanding spaced pins, and the stabilizer 870 can include a complementary second fastening feature 882, such as openings formed in the block 844 of the stabilizer 870. The mating of the first and second fastening features 880, 882 results in the stabilizer 870 being releasably attached to the upper surface of the belt 832. Similar to a previous embodiment, the block 844 can include a pair of slots, bore or openings 884 that contain a biasing element 886 that can have a ball like end 888. The bore 884 intersects and is in communication with the opening 882 and the pin 880 contains a dimple or recess 890 that receives the ball end 888 when the block 844 is received on the pins 880. More specifically, as the stabilizer 870 is placed on the surface of the belt 832, the pins 880 are received in the openings 882 and initially the pin 880 causes the biasing elements 886 to slightly retract and store energy until the pin 880 is aligned with and enters the recess 890 to thereby assist in locking the stabilizer 870 to the upper surface of the belt 832. To release the stabilizer 870, it is merely lifted to cause the biasing force of the element 886 to be overcome and the element 886 displaced from the recess 890.

Alternatively, the first and second fastening features can form a snap-fit connection resulting in each stabilizer 870 being snap-fittingly interlocked with the conveyor belt 832.

After one drug delivery bag 10 has been completely processed by the system 800, the stabilizer 870 can be manipulated to release the drug delivery bag 10 or the stabilizer 870 can be released from the conveyor belt 832 and then opened up to release the drug delivery bag 10. Any other types of interlocking or fastening means can be used to securely attach the stabilizer 870 to the conveyor belt 832.

In this embodiment, the stabilizer 870 includes blocks 842, 844 that each includes the pair of recessed channels 860; however, the block 842 is not an integral part of the conveyor belt 832 but instead, the blocks 842, 844 are separate therefrom. The blocks 842, 844 can function as previously described in that they are opened to receive the bag 10 and then locked relative to the bag 10, as described above, so that the bag 10 is securely captured and at least the fill port 16 extends a prescribed distance from the blocks 842, 844 so as to be accessible.

In the case where the stabilizer 870 is separate from the conveyor belt 832 and the system 800 in general, the stabilizer 870 does not have to be spring biased as shown in FIGS. 10A-10B but instead the stabilizer 870 can include some type of disengageable lock mechanism that can be actuated to lock the stabilizer 870 with the drug delivery bag 10 being captured therein and at least the port 16 being held and accessible. It will thus be appreciated that the clamping operation can take place at the loading station 120 itself in that loose bags 10 can be fed to a clamping device that applies the stabilizer 870 to the drug delivery bag 10 which is then coupled to the belt 832. Alternatively, the stabilizer 870 can be applied to the drug delivery bag 10 prior to the loading station 120 as at a remote location and then delivered to the loading station 120 where the stabilizer 870 is received and coupled to the conveyor belt 832.

As with the previous embodiment, the transport device is preferably in the form of a multiple station cam-indexing device that is adapted to perform material handling operations by using absolute encoder technology. The transport apparatus or conveyor is configured to have multiple stations positioned thereabout. The indexing/encoder aspects of the transport apparatus/conveyor permit it to be advanced at specific intervals (increments) and in particular, permits each loaded drug delivery bag 10 to be delivered to a precise location, such as a next station, where it is further processed, etc.

The system 800 also preferably includes one or more reading devices at station 13 that are capable of reading a label 11 or the like disposed on a sealed container containing the medication (e.g., a drug vial) or a label 11 associated with the drug delivery bag 10 or some other object. The label 11 is read using any number of suitable reader/scanner devices, such as a bar code reader, etc. Multiple readers can be employed in the system at various locations to confirm the accuracy of the entire process or even to receive instructions that influence how an operation is to be performed. For example, the one or more readers and a labeling station can be provided either before a drug filling station where the medication is delivered to the bag 10 or they can be located downstream or after the drug filling station or they can be located at both locations or one can be located upstream and one downstream of the drug filling station.

The operation and function of the readers and the labeling station are similar or identical to the disclosure above with respect to the placement of these components in the previously described embodiment of FIGS. 1A-1D. Thus, these components are not described in detail again. Further, it will be appreciated that the drug delivery device (bag) 10 can include the readable or readable/rewritable medium 20, such as an integrated circuit, e.g., an RFID tag 20. As mentioned above, it will also be appreciated that other types of custom information can be contained in the RFID tag 20 and more specifically, the RFID tag 20 can contain a product identifier uniquely associated with one or more entries in a database that can be accessed to obtain information related to the medical product. In addition, the information in the RFID tag 20 preferably includes dosage information that identifies the amount and/or concentration of the medical product, and/or a patient identifier that identifies a patient that is intended to receive this particular medical product. It will further be appreciated that the RFID tag 20 can contain other useful information in that it can contain administration requirements, instructions for use, and/or product warnings, such as possible allergic reactions or adverse interaction of the medical product with other medical products.

The information contained in the RFID tag 20 can also contain information that is related to the drug delivery bag 10. For example, the manufacturer and identifying information, such as the size or capacity of the drug delivery bag 10, can be contained in the RFID tag 20. The identifying information can be in the form of a volume or capacity of the drug delivery bag 10. For example, bags come in different volumetric sizes and therefore, during an operation, such as transfer or filling of the drug delivery bag 10 with the drug product, as described in detail below, it is desirable to confirm that the drug delivery bag 10 is of the correct type before the medical product is delivered to the drug delivery bag 10.

The information can be written into the RFID tag 20 at any number of different locations and times and by different persons. For example, some of the information may be written into the RFID tag 20 by the manufacturer of the medical product and/or by the manufacturer of the drug delivery device 10 as in the case where the type and/or size of the bag 10 is written into the RFID tag 20.

After the drug delivery bag 10 is loaded and depending upon which type of carrier or retaining type clamp mechanism is being used, the mechanism is closed so to securely position the bag 10 in a vertical position as described above.

The label 11 (e.g., barcode), RFID tag 20, or the like can then be read by a reader for the purpose of performing a medication integrity check (safety check) prior to delivering the medication to the bag 10. In FIGS. 7A-7B, the reader 13 and the labeling station 15 are illustrated as being downstream from the drug delivery station 300; however, while this location is a suitable location to perform safety and to confirm the accuracy of the fill, one or more of the reader 13 and the labeling station 15 can be located upstream from the drug delivery station 300 as described below even though this particular location is not illustrated in the FIGS. 7A-7B. For purposes of brevity, the reader 13 and labeling station 15 are illustrated as being downstream of the drug delivery station 300; however, they can instead be located upstream of the station 300 or there can be two sets of devices, one located upstream of station 300 and one located downstream of station 300.

The bag 10 is then advanced to the drug delivery station 300 where a predetermined amount of medication is delivered through the fill port 16 and into the bag 10. Any number of different means can be used for delivering the medication through the fill port 16 of the bag 10 with the necessary precision such that a prescribed amount of medication is delivered to the bag 10.

FIG. 7A illustrates one exemplary delivery station 300 that includes an automated, controllable drug transfer member 310 that is constructed to mate with the fill port 16 to permit delivery of medication from the drug transfer member 310 and through the fill port 16 into the interior of the bag 10. A seal should be formed between the drug transfer member 310 and the fill port 16 to ensure a complete and accurate transfer of medication into the bag 10. One exemplary drug transfer member 310 is a drug delivery needle (cannula) that includes a first end in the form of a sharp tip that is designed to pierce a rupturable septum that is part of the fill port 16. When the needle end pierces the septum, it can inject a controlled amount (dosage) of medication through the fill port 16 and into the bag 10 and since in some embodiments, the bag 10 is hung vertically, the injected medication flows by gravity into the interior of the bag 10. As is known, once the needle is removed from the fill port 16, the septum reseals itself.

It will also be understood that in another embodiment the needle end can include a connector or fitting or the like that mates with a similar structure on the end of the fill port 16 to create a sealed connection therebetween. This likewise permits the medication to be delivered into the interior of the bag 10.

It will be observed that the insertion of the needle into the fill port 16 requires a high level of precision with respect to the location of the fill port 16 and the needle and more particularly, requires the needle to be axially aligned with the fill port 16 so that when the needle is controllably advanced as described below, it engages and enters the fill port 16. The use of stabilizer 840 permits the fill port 16 to be held at a known, fixed location relative to the carrier or stabilizer structure itself and therefore, when the stabilizer is advanced to the station 300 in an indexed manner by means of the master controller, the location of the carrier or stabilizer in the station 300 is known and controlled. As a result, since the location of the fill port 16 relative to the carrier/stabilizer is known, the overall location (coordinates) of the fill port 16 within the station 300 is known and this permits the system 100 to be constructed so that the needle is advanced to this target location where the fill port 16 resides to permit engagement therebetween. As previously mentioned, the carrier/stabilizer also preferably regulates the length of the fill port 16 that extends beyond the carrier/stabilizer and therefore, the needle is automatically delivered to a proper location in that it does not extend either too far into the fill port 16 or not enough such that it is not in engagement with the fill port 16. In the case where the bag 10 is held horizontally, the needle is moved laterally toward the horizontally oriented bag 10 until the needle engages and sealingly mates with the fill port 16. In either embodiment, the use of a stabilizer 840 or 870 not only stabilizes and holds the bag 10, more particularly, the fill port 16 thereof, such that the needle can be inserted therein, but also, the stabilizer serves to fixedly locate the fill port 16 and permit other components, such as the needle, to be driven to known coordinates at various stations for performing an operation on the fill port 16 (e.g., delivering medication).

As shown in FIG. 7A, the needle is of the type that includes a needle engagement control unit 320 or some other type of means for moving the needle in a controlled manner and in a controlled direction. For example, the needle can be of the type that includes a linkage 330 that operably connects the needle to the control unit 320. In the illustrated embodiment, the linkage 330 is in the form of an arm that has a first section 332 that has the needle attached to one end thereof and a second section 334 that is operably coupled to the working components of the control unit 320. The control unit 320 includes a controller that is in communication with the master controller of the system 100.

The first and second sections 332, 334 can be formed at a right angle and the second section 334 can be in the form of a reciprocating piston that is operably connected to the motor as by a drive shaft etc., such that when the motor is operated, the piston 334 is driven to an extended position that causes the needle to be driven toward and into engagement with the fill port 16 and conversely, when the motor is operated again, the piston 334 is driven to a retracted position to cause the needle to be withdrawn (disengaged) from the fill port 16 and thus, permit the filled bag 10 to be advanced to a next station.

By having the controller in communication with the master controller, all of the events relating to the operation of the system 100 are able to be coordinated and more specifically, the motor of the unit 320 is timed so as to operate only after a new empty bag 10 has been delivered to the fill location of the station 300.

The drug delivery station 300 also includes a drug source 340 that contains a predetermined amount of a drug of a given type (product and dosage). For example, the drug source 340 can be in the form of a drug bag or a drug vial and in particular, the drug source can be hung vertically so that it can flow by gravity to another location, such as the needle for delivery to the bag 10. It will be appreciated that the operator can easily and readily change the drug source 340 based on the filling needs since the bags 10 likely require different medications and/or different concentrations of the same drug and therefore, different drug sources 340 are needed to be loaded and connected to the control unit 320 for delivery to the bags 10. In the illustrated embodiment, the drug source is in the form of a drug bag 340 (infusion bag) and the infusion port 18 is used to deliver the drug to the needle.

A conduit 350 is sealingly attached at a proximal end to the drug source 340 and a distal end is sealingly attached to the needle to permit the drug stored at source 340 to be delivered to the needle. When the drug source 340 is a drug delivery bag 340, the proximal end is attached to the infusion port 18. The conduit 350 is typically a tube or the like that carries the drug from the source 340 to the needle. Along the path of the conduit 350, a pump mechanism or the like 360 is disposed for controllably moving the drug from the source 340 to the needle. The pump mechanism 360 is in communication with the controller to permit the pump mechanism 360 to be controlled such that a predetermined amount of medication can be pumped through the conduit 350 and into the needle and then into the bag 10. For example, the pump mechanism 360 can be operated only when the needle is in an extended position and in engagement with the bag 10. Any number of different types of pump mechanisms 360 can be used including peristaltic pumps, motorized pumps, etc.

It will be appreciated that the fill instructions from the master controller to the controller depend upon the medication order for the particular drug delivery bag 10 that is present in the station 300 and ready to receive a dosage of medication. In other words, the master controller will send dosage fill instructions to the controller that in turn controls operation of the pump mechanism 360 based on the dosage fill instructions. The pump mechanism 360 is operated in such a way (e.g., turned on for a prescribed time period and/or run at a prescribed speed) that the predetermined desired amount of medication is dispensed through the needle into the bag 10. For example, if the instructions are to inject 50 ml of medication into the bag 10 the pump mechanism 360 operates differently than if the fill instructions are to inject 100 ml of medication into the bag 10.

A fluid (medication) transfer device identical or similar to that disclosed in commonly assigned U.S. Ser. No. 10/821,268, which is hereby incorporated by reference in its entirety, can be used at the medication delivery station and in combination with needle. The fluid transfer device is a spike-like instrument that includes a first section for piercing the septum of the fill port and a second section for sealingly yet releasably mating with the fluid delivery device (needle). The transfer device has a first channel extending through the first and second sections for carrying the medication and a second channel that is in fluid communication with a vent that is formed as part of the transfer device to permit air to flow into the fill port.

As mentioned above, the fluid transfer device can be readily changed and replaced with another (the same or different type), and in addition, the conduit 350 can likewise be changed depending upon different parameters and needs, including the volume of medication to deliver to the bag 10.

An automatic device 560 for opening the stabilizer 190 is provided and illustrated in FIG. 7A. The device 560 includes an actuatable tool 562 that is configured to mate with notch 854 formed in the movable block 844. In one embodiment, the tool 562 is part of a first reciprocating piston 570 that is controllably driven by motor 572 so that the tool 562 can be extended and retracted in a horizontal direction. This permits the tool 562 to be extended and driven into engagement with the notch 854. It will further be appreciated that the first piston 570 can be part of a unit 574 that is itself coupled to a second reciprocating piston 580 that can be operated by means of a motor 582 to cause the unit 574, and the first piston 570, to move in vertical (up-and-down) direction so as to vertically position the first piston 570 in a desired horizontal plane and in particular, the tool 562 is positioned in the proper horizontal plane so that when it is extended it can enter the notch 854.

The controlled horizontal and vertical movement of the tool 562 causes the lifting or closing of the block 844 relative to the block 842, thereby permitting the bag 10 to be either released from the blocks 842, 844 or securely captured therebetween. For example, once the tool 562 enters the notch 854, vertical movement of the piston 580 causes the block 844 to either lift up as when the piston 580 is driven upward or close when the piston 580 is driven downward.

It will be appreciated that the illustrated device 560 is merely one mechanism and one manner of opening and closing the stabilizer 840 and there are many other suitable types of mechanisms and methods, including other pneumatic or mechanical techniques.

After the medication has been delivered to the bag 10 and the medication transfer operation has been completed, the needle is withdrawn and moved to the retracted position and the filled bag 10 is preferably then subjected to a process that checks the integrity of the medication transfer process. Not only can this include reading or scanning a bar code to again check the accuracy of the fill and placing another label on the bag, by the devices described above, but also, it can include a fill dose verification by weight process. This weight verification step can be performed at a separate station 370 from station 300 or it can be a substation that exists within the station 300. In either case, the filled bag 10 is set on a scale or the like or some other device 380 for measuring the mass (weight) of the filled bag 10. The target weight of the filled bag 10 is stored in memory of the master controller and thus, the measured weight can easily be compared to the target weight and if the measured weight is within an acceptable range then the bag 10 is advanced to a next station. However, if the measured weight of the filled bag 10 falls outside of the acceptable range, then the operator is notified and the master controller can take appropriate action which can be in the form of preventing the bag 10 from being advanced to the next station. The operator can be notified of the discrepancy in the measured weight by the automated process and then manual verification techniques can be used to determine if the weight of the filled bag 10 is within an acceptable range.

In one exemplary embodiment illustrated in FIG. 7B, the bag 10 is introduced to the station 370 by first releasing or ejecting the bag 10 from the stabilizer 840 using the device 560 that is received in release notch 854 of block 844 and then lifts the block 844.

The filled bag 10 can then be delivered onto a ramp structure 371 which delivers the bag 10 to the station 370 and in particular onto the scale 380 where the weight of the bag 10 can be calculated.

Once the filled bag 10 is approved for final distribution, whether or not the bag 10 was subjected to the optional weight verification station 370, the filled bag 10 is delivered to another station by means of a transport device, such as conveyor 373. Any number of techniques and mechanisms can be used to advance the filled bag 10 from the station 370 (e.g., from the scale 380) to the next station. In the illustrated embodiment of FIG. 7A, an actuatable drive member 391 is provided for selectively contacting and moving the bag 10 off the scale 380 and onto the conveyor 373. For example, the drive member 391 can be in the form of an extendable/retractable plow member 393 that is driven by means of a reciprocating piston 395 by means of a motor 397. When the drive member 391 is driven into an extended state, the plow member 393 contacts and drives the bag 10 off of the scale 380 and onto the conveyor 373.

The filled bag 10 is preferably subjected to a labeling process in which a final label 11 is applied to the bag 10 at a labeling station that contains a printer for printing the label 11 and a device for applying the printed label to the surface of the bag 10. The final label 11 includes all relevant information including patient identification information and product identification information, including dosage related information. Additional information can be included on the label 11 and while the label typically includes barcode information, other written information can be written on the label 11.

As part of the final product verification process, the final label 11 can be read (e.g., scanned) to verify that the label 11 contains the correct information and is otherwise complete. For example and in the case of barcode encoded information, a scanner can be used to read the barcode information and then compare this read information to information that is stored in the memory (e.g., the inputted medication order) to determine if any discrepancies exist within the patient identification information and/or the product identification information (dosage information). If a discrepancy exists, the master controller alerts the operator and either takes active remedial steps, such as rejecting the bag 10 and delivering it to another station for manual inspection, or prevents the rejected bag 10 from advancing to the next station and allows the operator to remove the rejected bag 10. This verification process preferably occurs at or near the labeling station 390; however, it can be at a separate station if desired.

It will also be appreciated that if the bag 10 has an RFID tag 20 attached thereto, then the tag 20 can be read instead of a barcode for purpose of verifying the that product in the bag 10 is the correct one and in particular, the information written in the RFID tag 20 is compared to the information stored in memory to see if there are any discrepancies between the two sets of information.

The bag 10 is then delivered to a bag removal station 400 where the bag 10 is removed from the transport device 830. Any number of different bag removal mechanisms 410 can be used to remove the filled bag 10 from the transport device 830 and permits the bag 10 to be delivered to another location, such as to a bag collector. It will be understood that the bag removal process can either be a manual operation, a partially manual operation or a completely automated process. When the bag removal device is at least partially automated, the device can be a robotic device that includes a robotic arm that is configured to be moved into position and grasp the filled bag 10 and then remove it from the transport device 830 with or without a carrier or stabilizer attached thereto. The robotic arm can have a gripper or the like for grasping and holding either the carrier or stabilizer directly or the bag directly. After grasping the carrier/stabilizer or the bag, the robotic arm then is moved so that the filled bag is located above or near a collection bin, container, or the like and then the filled bag 10 is deposited therein.

It will also be appreciated that a reader can be installed at the bag removal station 400 for the purpose of recording and confirming that the filled bag has been deposited into a target member, such as a bag collector. Once again, since the system 100 and in particular, the transport device 830, operates with high precision indexed movement, the master controller knows at any particular point in time which filled bag 10 is entering the bag removal station and thus, like the other reading operations, the reader reads the identifying information (patient and/or product identification information) and compares it to the stored information and if any discrepancy exists, the operator is notified so that remedial action can be taken.

Since the systems 100, 800 can be a closed loop system, the transport device continues moving and loops back toward the loading station 120 to permit additional bags 10 to be loaded in this design.

It will also be appreciated that the station 300 can include a drug preparation system, similar to that disclosed in commonly assigned U.S. Pat. No. 6,915,823 (which is hereby incorporated by reference in its entirety), where medication is prepared from a drug vial (containing the drug in powder form) and is then diluted to form a medication have the prescribed dosage characteristics. This arrangement can be used instead of providing a drug source and then withdrawing premade medication.

According to one aspect of the present invention and when an RFID tag 20 is used in combination with the syringe 10, an RF reader or RF reader/writer ("RF device") can be provided at any number of different locations of the automated system 100 where it is desired to have communication between the syringe 10 (RFID 20 thereof) and the RF reader/writer. In particular, the RF device can be disposed between any two stations that form a part of the system 100. For example, there can be an RF reader immediately downstream of the loading station 120 that is used to confirm that the type of bag 10 is proper. In addition, a reader can be located at the medication fill station 300 such that, according to one embodiment, the information contained in the RFID tag 20 can actively instruct the drug transfer member 310 at the drug delivery station 300 to perform the drug delivery operation and deliver the proper predetermined dosage of medication from the source 340. The reader receives the detailed dosage information contained in the tag 20 and based on this information, the controller 320 instructs the pump mechanism 36 how to operate and deliver the appropriate amount of medication.

The RF device is part of the overall system 100, 800 such that it is in communication (e.g., wired or wireless) with other components of the system and in particular, with one or more processors or controllers thereof, such as a master controller that can be in the form of a computer). This permits the information that is read by the RF device to be compared with stored information to check the integrity of a process or application.

In yet another embodiment, the RF device is located just prior to (upstream) the station where a label or the like is printed for placement on the bag 10. At this location, the RF device can provide an integrity check prior to the label being printed and permanently placed on the syringe so as to ensure that the contents of the syringe are proper and/or other information is accurate, such as a patient identifier or location to which the syringe is to be delivered. For example, it is desirable prior to medication identifying information, such as the drug contents, dose, usage schedule/instructions, strength, warnings, etc., being printed on the label that the veracity of the drug contents is confirmed. In other words, the RFID tag 20 has medication identifying information written therein and the RF device reads the information stored in the tag 20 and then compares it to information that is stored in memory (e.g., database) to check whether certain parameters are within appropriate limits or ranges or that the information written in the tag 20 matches the stored information. For example, the type of medication, the dosage amount, etc. must match between what is recorded on the RFID tag 20 and that which is stored in memory (e.g., database) and identified as corresponding to this particular syringe.

If a match does not exist or if the information is outside of a particular limit or range, then the system 100 is preferably configured so as to take affirmative action to be this particular syringe from being advanced to the next station and preferably, some type of warning (audible and/or visual) is provided to alert the operator as to the discrepancy between the information written in the tag 20 and that which was previously entered and stored in the system's memory. For example, if the RFID tag 20 indicates that the medication within the associated bag is penicillin, due to this information being written in the tag 20 at the previous fluid transfer station; however, the information stored in the computer indicates that this particular bag that is identified by a number of different means, including its location on the transport device 130, 830, indicates that the bag contains amoxicillin, then the system recognizes this discrepancy and appropriate remedial action is taken, which likely includes preventing the syringe 10 from being advanced to a next station alerting the operator. The records can be checked by the operator in an attempt to resolve the discrepancy and the operator may likewise wish to check bags downstream in order to see if there are any differences between the information contained in the RFID tags 20 and the information stored in the computer's memory. Once the discrepancy is resolved, the operator can then restart the system and the transport device 130, 830 to continue the operations that are performed at the respective stations. While the above example is discussed in terms of a discrepancy between the type of medication contained within the bag, it will be appreciated that the discrepancy can be between any number of other pieces of identifying information, such as the dosage amount, the strength of the medication, patient identifying information, the location to which the medication is to be routed, etc.

It will be appreciated that this is merely one exemplary use of the RFID tag 20 and that any number of other uses can be envisioned for the RFID tag 20 since the free communication between the RFID tag 20 and the reader and the master controller permits information to be received from the RFID tag 20 so as to influence or instruct how an operation is performed at one more stations and in addition, information can be written to the RFID tag 20 as a safety check and a means for later verifying certain events. Moreover, information that is written to the RFID tag 20 can later be read by a downstream reader which then performs a certain operation based on the information that was written on the RFID tag 20.

In addition, the bag 10 can contain the control feature that is described in commonly assigned U.S. Pat. Nos. 6,722,404 and 7,025,098, both of which are hereby expressly incorporated by reference in their entireties.

In yet another embodiment, the RFID tag 20 is removably coupled to the bag 10 to permit reuse of the RFID tag 20 and/or to permit the tag 20 to be archived. For example, the detachable RFID tag 20 can be removed from the bag 10, after the intended application is complete, and can be archived for later consultation. In other words, the RFID tag 20 can be placed in a log book and identified in the log book by some type of identifying information and if at a future date, there is a need to view the information contained in the RFID tag 20, the tag 20 is simply retrieved and its information is viewed. Alternatively, the RFID tag 20 can be simply removed from the syringe and the information contained therein is cleared, thereby permitting the tag 20 to be reused on another bag as by simply affixing the tag 20 to the other bag.

Any number of different means or techniques can be used for associating one tag 20 to one bag 10. For example, the syringe 10 can include a pocket or the like that is formed as part of or is attached to the outer surface of the bag and is configured to receive and hold one tag 20. Alternatively, the RFID tag 20 can include some type of fastening means that mates with a feature formed as part of the syringe to permit the tag 20 and bag 10 to be releasably locked with one another, e.g., a snap fit connection can be formed between the tag 20 and the bag 10 or even a hook and loop can be formed between the two parts. The connection of the tag 20 to the bag 10 should be strong and robust enough that the tag 20 is maintained on the syringe during the entire process and as it is advanced from station to station.

This arrangement permits the RFID tag 20 to be consistently reused instead of being discarded along with the used syringe after the medication contained therein has been discharged. This reduces the overall costs of the system since the tags 20 are not merely discarded but are used again.

In addition and in the embodiment where the medication is prepared in real time at the drug delivery station 300, the RFID tag 20 can include information that relates to the operations that are performed at the station 300. As a result and as shown in FIG. 1, a reader 500 can be disposed between the station 120 and the drug delivery station 300 and is in communication with the master controller and thus, the fluid transfer device so that the RFID tag 20 instructs the fluid transfer device how to formulate and make the desired unit dose of medication.

In yet another aspect, the RFID tag 20 can have processing or routing information written therein in that the tag 20 includes instructions relating to how the bag 10 is to be processed after it has been filled. For example, the RFID tag 20 can include instructions or an identifier that identifies, at least in part, an end location or the like where the bag is to be routed. For example, the tag 20 can include a code that represents a final destination, such as a hospital or a medical facility, clinic, etc. In other words, the routing of the bags 10 can be facilitated by introducing a code (number, letter, or a combination thereof) that identifies a specific location where the bag 10 should be delivered such that when the reader reads the code stored in the tag 20, the system takes the necessary steps to ensure that the bag 10 is delivered to the correct location. For example, a mechanical device, such as a sweeper or the like, that is part of the automated system and in communication with the control system can be operated to direct a first group of syringes along one route that ensures that all of the bags of the first group are delivered or are packaged for delivery to a first location, while a second group of bags is directed along a different route that ensures that all of the bags of the second group are delivered or are packaged for delivery to a second location. In this manner, the RFID tag 20 provides instructions to the automated system for performing one or more operations therewith.

An end use location, such as a pharmacy or healthcare facility, typically includes a healthcare database that can include a patient file uniquely associated with each individual patient admitted in the healthcare facility. Each of the patient files can include the patient's name, address, social security number, and/or patient ID, which can be assigned to the patient upon admission to the healthcare facility. Each of the patient files may also include the medical products prescribed to the respective patient and/or a record of the medical products administered to the respective patient, including dates and time of administration, the healthcare worker who administered the medical products, and the like. Each of the patient files may also include the current location of the respective patient within the healthcare facility, e.g., the floor and/or room number of the patient in the healthcare facility. The information in the database can further include insurance billing information for each individual patient, including the name, telephone number, billing address, and/or group ID of the patient's insurer. In addition, the information in the database can include a healthcare worker file associated with each individual healthcare worker working at the healthcare facility.

In a first step, the facility, such as a pharmacy, receives a shipment of medical products, such as filled bags. Preferably, each of the medical products can be identified by one RFID tag 20 which is preferably attached to the bag itself or could be attached to a package or container that contains the medical product. Each of the tags 20 preferably includes product information for the associated medical product, including a serial number and/or an NDC, the product name, the manufacturer's name, a lot number, and/or an expiration date. Alternatively, or in addition, each of the tags 20 can include a product identifier uniquely associated with one or more entries in a database that may be accessed to obtain information related to the associated medical product.

In a second step, the product information in the RFID tags 20 of the received medical products is read into a terminal (e.g., a PC) at the facility using the RF reader. In another step, the terminal transmits the product information read from the tags 20 of the received medical products to a main computer via a conventional communication link (wired or wireless). The computer can use this received information to update the inventory in the database accordingly. In an optional step, the main computer at the end facility and the database thereof receives information of the medical products shipped to the healthcare facility from the manufacturer (i.e., where the syringes are filled). This information can be downloaded into the database from a remote manufacturer database (not shown) via, e.g., an Internet link. From a CD-ROM disc included with the medical product shipment, or the like. The information of the medical products shipped to the healthcare facility can include the lot number, NDC, and product name of each of the medical products shipped to the healthcare facility.

In an optional next step, the main computer can be configured to compare the information of the medical products shipped to the healthcare facility with the information received from the terminal at the facility to verify that all of the medical products shipped to the healthcare facility were received by the pharmacy. The comparison can be done between lot numbers of the medical products or some other identifying information of the medical products.

After the medical product is prepared for the patient, the medical product can be grouped with other prepared medical products for transport to a medication-dispensing unit. As the medical products are withdrawn from a facility, such as the pharmacy, for transportation to the medical-dispensing unit, the information in the tags 20 of the medical products can be read into a terminal using the RF reader. For example, all of the medical products can be identified by passing a cart or other device carrying the medical products into close proximity with the RF reader, thereby simultaneously reading all of the tags 20 identifying the medical products.

For example, the RF reader can be mounted to a doorway of the facility (pharmacy) for automatically reading the RFID tags 20 of the medical products as they are withdrawn from the facility. The terminal at the facility (pharmacy) can also identify the medication-dispensing unit intended to receive the medical products. This can be done by having a healthcare worker manually entering the identity of the of the dispensing unit into the pharmacy terminal and/or reading an RFID tag 20 identifying the dispensing unit using the RF reader. This can also be done by reading a patient identifier and/or location from the RF tags 20 of the medical products into the pharmacy terminal and having the pharmacy terminal access a database matching the patient identifier and/or location with an assigned dispensing unit.

The pharmacy terminal can then transmit the information read from the RFID tags 20 of the medical products to the main computer and can likewise transmit the identity of the dispensing unit to receive the medical products and/or the identity of the healthcare worker transporting the medical products to the dispensing unit. Medication dispensing units can be placed throughout the medical facility for temporarily storing medical products and for dispensing the medical products to the healthcare workers, e.g., nurses, assigned to administer the medical products to the patients. Each of the medication dispensing units, e.g., stationary medication stations and/or movable medication carts, can be located on the same floor, wing, and the like of the healthcare facility as the patients intended to receive the medical products stored therein.

In addition, the system 100, 800 can include the above features as well as others that permits it to offer system controls that are capable of providing the following features: (a) drug accounting and formulary control; (b) drug tube and needle/spike change requirements to prevent drug cross contamination; (c) interface with the hospital information system and other product storage systems; (d) generation of labels to be used during the overall drug preparation process; (e) support barcode and RFID end product labeling technology; (f) electromechanical machine control; (g) configurable user security level controls; and (h) clean filling environment.

It will be appreciated by persons skilled in the art that the present invention is not limited to the embodiments described thus far with reference to the accompanying drawings; rather the present invention is limited only by the following claims.

What is claimed is:

1. An automated medication preparation system for delivering a dosage of medication to a drug delivery bag having a fill port through which the medication is delivered into the bag comprising: an automated transport device for controllably delivering each drug delivery bag from one location to another location via a driven member; a carrier that releasably captures and holds a portion of the bag and orients each bag such that the fill port of each bag is positioned at a uniform location relative to the carrier; the carrier being coupled to the transport device such that movement of the driven member is translated into movement of the carrier and the captured drug delivery bag; an automated drug delivery device that includes a drug delivery member that sealingly mates with the fill port for delivering the dosage of medication to the bag; and a controller in communication with the automated transport device for moving the automated transport device in an indexed manner including moving the carrier to a fill location where the fill port and the drug delivery member are aligned to permit the sealed mating between the two and transfer of the dosage of medication, wherein the automated transport device comprises a conveyor mechanism that includes a guide rail the at least partially surrounds the driven member and a mounting structure that is connected to the driven member and driven therewith, the carrier being coupled to the mounting structure such that the bag hangs vertically from the carrier as it is advanced from one location to the other location.

2. The system of claim 1, wherein the drug delivery bag comprises an infusion bag including the fill port and an infusion port.

3. The system of claim 1, wherein the driven member is one of a chain and a belt.

4. The system of claim 1, wherein the guide rail includes a longitudinal slot through which a first portion of the mounting structure extends, the mounting structure being a bracket that includes the portion attached to the driven member and extending through the longitudinal slot for positioning the bag outside the guide rail to permit vertical hanging of the bag.

5. The system of claim 1, wherein the carrier has at least a first part that is fixedly attached to the mounting structure and a movable part that is biased against the first part, with the bag being captured between the movable part and the fixed part.

6. The system of claim 5, wherein the first and second parts are spring biased or are either pneumatically or electrically controlled.

7. The system of claim 1, wherein the carrier is a separate member relative to the mounting structure and is disengageably coupled to the mounting structure to permit the bag to be captured and held by the carrier prior to coupling the carrier to the mounting structure.

8. The system of claim 7, wherein the carrier is defined by a pair of blocks that are biased with respect to one another so as to grip and hold the bag therebetween.

9. The system of claim 1, wherein the carrier includes an opening through which the fill port extends and is held so as to fixedly locate the fill port at a predetermined fixed location of the carrier, with a distal portion of the fill port extending a predetermined height above the carrier so as to be free for mating with the drug delivery member.

10. The system of claim 1, wherein the automated drug delivery device comprises a drug delivery needle and includes a local controller for controlling the movement of the drug delivery device and a source of medication that is fluidly connected to the drug delivery device and is delivered thereto by means of creating negative pressure in the drug delivery device to drawn the medication therein.

11. The system of claim 10, wherein the controller uses absolute encoder technology or laser guiding to perform positional indexing to permit controlled movement of the transport device so as to deliver one bag to a target location where an operation can be performed on the bag.

12. The system of claim 1, wherein the controller is in communication with the automated drug delivery device and includes a database for storing drug dosage information that is used to control the automated drug delivery device for delivering the dosage of medication to the bag.

13. The system of claim 12, wherein the database stores patient identifying information.

14. The system of claim 1 , further including: a first label that is attached to the bag and includes identification information that identifies the bag itself.

15. The system of claim 14, further including: a second label that is attached to the bag and includes product identification information.

16. The system of claim 15, further including a reader that is in communication with the controller and is configured to read the information on the second label, wherein the controller compares the read information with medication order information previously inputted and if any discrepancy exists, the controller prevents the bag from being delivered to the drug delivery device.

17. The system of claim 14, further including a reader that is in communication with the controller and is configured to read the information on the first label, wherein the controller associates the read information with a selected medication preparation order to permit each medication order and each bag to be tracked from one station to another station.

18. The system of claim 1, wherein each bag includes a readable/rewritable medium that contains at least a first set of information that identifies the type of bag to which the readable/rewritable medium is coupled to.

19. The system of claim 18, wherein the readable/rewritable medium comprises an RFID tag including dosage instructions.

20. The system of claim 19, wherein the system includes an RF reader or RF reader/writer that communicates with the RFID tag and with the controller so that information including the dosage instructions from the RFID tag are communicated to the controller and then delivered to the drug delivery device which in turn prepares the dosage of medication based on the dosage instructions.

21. The system of claim 18, wherein the readable/rewritable medium includes a second set of information that includes dosage information that identifies a product identifier that identifies the medication, a volume of the dosage, and a concentration of the dosage.

22. The system of claim 1, further including: a weight verification station including a device for measuring a tare weight of the bag and for measuring the weight of the bag filled with the dosage of medication, the device being in communication with the controller such that the controlled calculates the difference in the two measurements and if the weight difference is outside a predetermined range, the controller rejects the filled bag for further inspection.

23. The system of claim 1, further including: a bag loading station where a plurality of bags are automatically loaded onto the transport device; a clamping station where the carrier is placed into a locked position by means of an automated clamping device, with an empty bag being securely held within the locked carrier; and a scanning station where the loaded bag is compared to that required by the medication order and rejected if the bag is not of the correct configuration.

* * * * *